US011605348B2

(12) United States Patent
Xuan et al.

(10) Patent No.: US 11,605,348 B2
(45) Date of Patent: Mar. 14, 2023

(54) PIXEL CIRCUIT AND CONTROL METHOD THEREFOR, DISPLAY DEVICE

(71) Applicant: BOE TECHNOLOGY GROUP CO., LTD., Beijing (CN)

(72) Inventors: Minghua Xuan, Beijing (CN); Dongni Liu, Beijing (CN); Haoliang Zheng, Beijing (CN); Li Xiao, Beijing (CN); Xue Dong, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 44 days.

(21) Appl. No.: 17/433,402

(22) PCT Filed: Sep. 28, 2020

(86) PCT No.: PCT/CN2020/118228
§ 371 (c)(1),
(2) Date: Aug. 24, 2021

(87) PCT Pub. No.: WO2022/061846
PCT Pub. Date: Mar. 31, 2022

(65) Prior Publication Data
US 2022/0270549 A1 Aug. 25, 2022

(51) Int. Cl.
*G09G 3/20* (2006.01)
*G09G 3/3258* (2016.01)

(52) U.S. Cl.
CPC ..... *G09G 3/3258* (2013.01); *G09G 2310/061* (2013.01); *G09G 2310/08* (2013.01); *G09G 2320/0247* (2013.01)

(58) Field of Classification Search
CPC ..... G09G 3/2022; G09G 3/32; G09G 3/3258; G09G 3/3233; G09G 3/3291;
(Continued)

(56) References Cited

U.S. PATENT DOCUMENTS

2014/0139502 A1* 5/2014 Han ..... G09G 3/3233 345/212
2016/0210900 A1* 7/2016 Kim ..... G09G 3/3266
(Continued)

FOREIGN PATENT DOCUMENTS

CN 108010489 A 5/2018
CN 109872680 A 6/2019
(Continued)

*Primary Examiner* — Michael J Eurice
(74) *Attorney, Agent, or Firm* — IP & T Group LLP

(57) ABSTRACT

A pixel circuit includes an input circuit and a time control circuit. The input circuit includes a driving transistor, and the input circuit is configured to write a data signal into a gate of the driving transistor in response to a first gate signal, so that the driving transistor outputs a driving signal for driving an element to be driven to emit light according to a gate voltage and a source voltage thereof. The time control circuit is coupled to the input circuit and the element to be driven, and is configured to control the input circuit to transmit the driving signal to the element to be driven for a first duration, and control the input circuit to transmit the driving signal to the element to be driven for a second duration. The second duration is shorter than the first duration, and includes a plurality of phases spaced apart.

20 Claims, 18 Drawing Sheets

(58) Field of Classification Search
CPC ... G09G 2300/0819; G09G 2300/0842; G09G 2300/0852; G09G 2300/0861; G09G 2310/061; G09G 2310/08; G09G 2320/0233; G09G 2320/0247; G09G 2320/043
See application file for complete search history.

(56) References Cited

U.S. PATENT DOCUMENTS

| | | | | |
|---|---|---|---|---|
| 2016/0218155 | A1* | 7/2016 | Park | H01L 27/3276 |
| 2016/0358547 | A1* | 12/2016 | Zhu | G09G 3/3233 |
| 2019/0096333 | A1 | 3/2019 | Park et al. | |
| 2021/0201760 | A1 | 7/2021 | Wang et al. | |
| 2021/0407376 | A1 | 12/2021 | Yue et al. | |
| 2022/0005403 | A1 | 1/2022 | Yue et al. | |

FOREIGN PATENT DOCUMENTS

| | | | |
|---|---|---|---|
| CN | 110021263 | A | 7/2019 |
| CN | 110021264 | A | 7/2019 |
| CN | 111179836 | A | 5/2020 |

* cited by examiner

PIXEL CIRCUIT AND CONTROL METHOD THEREFOR, DISPLAY DEVICE

CROSS-REFERENCE TO RELATED APPLICATIONS

This application is a national phase entry under 35 USC 371 of International Patent Application No. PCT/CN2020/118228, filed on Sep. 28, 2020, which is incorporated herein by reference in its entirety.

TECHNICAL FIELD

The present disclosure relates to the field of display technologies, and in particular, to a pixel circuit and a control method therefor, a display device.

BACKGROUND

Compared with an organic light-emitting diode (OLED) display device, a micro light-emitting diode (Micro-LED) display device and a mini light-emitting diode (Mini-LED) display device have a higher luminescent efficiency, a higher reliability and a lower power consumption, and may become a mainstream display product in the future. In the Micro-LED display device and the Mini-LED display device, pixel circuits are used for driving LEDs to emit light, so as to realize a display function. Therefore, structures of the pixel circuits are essential for ensuring display effects of the Micro-LED display device and the Mini-LED display device.

SUMMARY

In one aspect, a pixel circuit is provided. The pixel circuit includes an input circuit and a time control circuit. The input circuit includes a driving transistor, and is configured to write a data signal provided by a data signal terminal into a gate of the driving transistor in response to a first gate signal provided by a first gate signal terminal, so that the driving transistor outputs a driving signal for driving an element to be driven to emit light according to a gate voltage of the driving transistor and a source voltage of the driving transistor. The time control circuit is coupled to the input circuit and is configured to be coupled to the element to be driven, and the time control circuit is further configured to: control the input circuit to transmit the driving signal to the element to be driven for a first duration in response to a first control signal provided by a first control signal terminal; and control the input circuit to transmit the driving signal to the element to be driven for a second duration in response to a second control signal provided by a second control signal terminal. The second duration is shorter than the first duration, and the second duration includes a plurality of time periods spaced apart.

In some embodiments, the time control circuit is further configured to: control the input circuit to transmit the driving signal to the element to be driven for the first duration in response to the first gate signal; and control the input circuit to transmit the driving signal to the element to be driven for the second duration in response to the first gate signal and a third control signal provided by a third control signal terminal. The third control signal and the first control signal are mutually inverted signals.

In some embodiments, the time control circuit is further configured to: control the input circuit to transmit the driving signal to the element to be driven for the first duration in response to the first gate signal; and control the input circuit to transmit the driving signal to the element to be driven for the second duration in response to a second gate signal provided by a second gate signal terminal. The second gate signal and the first gate signal are mutually inverted signals.

In some embodiments, the time control circuit is further configured to receive the first control signal or the second control signal, in response to a fourth control signal provided by a fourth control signal terminal.

In some embodiments, the input circuit is further configured to reset the gate of the driving transistor, or reset the gate of the driving transistor and an anode of the element to be driven, in response to a reset signal provided by a reset signal terminal.

In some embodiments, the input circuit is further configured to control a first power supply voltage signal provided by a first power supply voltage signal terminal to transmit to the driving transistor, and control the driving signal to transmit to the time control circuit, in response to a light emission control signal provided by a light emission control signal terminal.

In some embodiments, the input circuit includes: a second transistor, a third transistor, a sixth transistor and a first capacitor, and the third transistor is the driving transistor. A gate of the second transistor is coupled to the first gate signal terminal, a first electrode of the second transistor is coupled to a second electrode of the third transistor, and a second electrode of the second transistor is coupled to a first node. A gate of the third transistor is coupled to the first node, a first electrode of the third transistor is coupled to a second electrode of the sixth transistor, and the second electrode of the third transistor is coupled to a fifth node. A gate of the sixth transistor is coupled to the first gate signal terminal, and a first electrode of the sixth transistor is coupled to the data signal terminal. A terminal of the first capacitor is coupled to the first node, and another terminal of the first capacitor is coupled to a first power supply voltage signal terminal.

In some embodiments, the input circuit further includes a first transistor; a gate of the first transistor is coupled to a reset signal terminal, a first electrode of the first transistor is coupled to an initialization signal terminal, and a second electrode of the first transistor is coupled to the first node.

In some other embodiments, the input circuit further includes a first transistor and a twelfth transistor. A gate of the first transistor is coupled to a reset signal terminal, a first electrode of the first transistor is coupled to an initialization signal terminal, and a second electrode of the first transistor is coupled to the first node. A gate of the twelfth transistor is coupled to the first gate signal terminal, a first electrode of the twelfth transistor is coupled to the initialization signal terminal, and a second electrode of the twelfth transistor is configured to be coupled to an anode of the element to be driven.

In some embodiments, the input circuit further includes a fourth transistor and a fifth transistor. A gate of the fourth transistor is coupled to a light emission control signal terminal, a first electrode of the fourth transistor is coupled to the first power supply voltage signal terminal, and a second electrode of the fourth transistor is coupled to the first electrode of the third transistor. A gate of the fifth transistor is coupled to the light emission control signal terminal, a first electrode of the fifth transistor is coupled to the second electrode of the third transistor, and a second electrode of the fifth transistor is coupled to the time control circuit.

In some embodiments, the time control circuit includes a seventh transistor and a ninth transistor. A gate of the seventh transistor is coupled to the first control signal terminal, a first electrode of the seventh transistor is coupled to the input circuit, and a second electrode of the seventh transistor is configured to be coupled to the element to be driven. A gate of the ninth transistor is coupled to the second control signal terminal, a first electrode of the ninth transistor is coupled to the input circuit, and a second electrode of the ninth transistor is configured to be coupled to the element to be driven.

In some embodiments, the time control circuit further includes an eighth transistor and a tenth transistor.

A gate of the eighth transistor is coupled to the first gate signal terminal, a first electrode of the eighth transistor is coupled to the first control signal terminal, and a second electrode of the eighth transistor is coupled to the gate of the seventh transistor.

A gate of the tenth transistor is coupled to a second gate signal terminal, a first electrode of the tenth transistor is coupled to the second control signal terminal, and a second electrode of the tenth transistor is coupled to the gate of the ninth transistor. A second gate signal provided by the second gate signal terminal and the first gate signal provided by the first gate signal terminal are mutually inverted signals.

In some embodiments, the time control circuit further includes an eighth transistor, a tenth transistor and an inverter.

A gate of the eighth transistor is coupled to a fourth control signal terminal, a first electrode of the eighth transistor is coupled to the first control signal terminal, and a second electrode of the eighth transistor is coupled to the gate of the seventh transistor.

A gate of the tenth transistor is coupled to an output terminal of the inverter, a first electrode of the tenth transistor is coupled to the second control signal terminal, and a second electrode of the tenth transistor is coupled to the gate of the ninth transistor.

An input terminal of the inverter is coupled to the fourth control signal terminal.

In some embodiments, the time control circuit further includes an eighth transistor, a tenth transistor and an eleventh transistor.

A gate of the eighth transistor is coupled to the first gate signal terminal, a first electrode of the eighth transistor is coupled to the first control signal terminal, and a second electrode of the eighth transistor is coupled to the gate of the seventh transistor.

A gate of the tenth transistor is coupled to a second electrode of the eleventh transistor, a first electrode of the tenth transistor is coupled to the second control signal terminal, and a second electrode of the tenth transistor is coupled to the gate of the ninth transistor.

A gate of the eleventh transistor is coupled to the first gate signal terminal, a first electrode of the eleventh transistor is coupled to a third control signal terminal.

In some embodiments, the time control circuit further includes a second capacitor and a third capacitor. A terminal of the second capacitor is coupled to the gate of the tenth transistor, another terminal of the second capacitor is coupled to a ground terminal. A terminal of the third capacitor is coupled to the gate of the seventh transistor, and another terminal of the third capacitor is coupled to the ground terminal.

In another aspect, a display device is provided. The display device includes the pixel circuit according to any of the above embodiments.

In yet another aspect, a control method for the pixel circuit is provided. The control method includes at least a data-writing period and a light-emitting period.

In the data-writing period, the input circuit writes the data signal provided by the data signal terminal into the gate of the driving transistor in response to the first gate signal provided by the first gate signal terminal, so that the driving transistor outputs the driving signal for driving the element to be driven to emit light according to the gate voltage of the driving transistor and the source voltage of the driving transistor.

In the light-emitting period, the time control circuit controls the input circuit to transmit the driving signal to the element to be driven for the first duration in response to the first control signal provided by the first control signal terminal, and the time control circuit controls the input circuit to transmit the driving signal to the element to be driven for the second duration in response to the second control signal provided by the second control signal terminal. The second control signal is a square wave signal, and the second duration includes the plurality of time periods spaced apart.

In some embodiments, in the light-emitting period, the time control circuit controls the input circuit to transmit the driving signal to the element to be driven for the first duration further in response to the first gate signal, and controls the input circuit to transmit the driving signal to the element to be driven for the second duration further in response to the first gate signal and a third control signal provided by a third control signal terminal. The third control signal and the first control signal are mutually inverted signals.

In some embodiments, the control method further includes a reset period before the data-writing period.

In the reset period, the input circuit resets the gate of the driving transistor, in response to a reset signal provided by a reset signal terminal.

In some other embodiments, in the data-writing period, the input circuit resets the element to be driven, in response to the first gate signal.

In some embodiments, a frequency of the second control signal is 3000 HZ.

BRIEF DESCRIPTION OF THE DRAWINGS

In order to describe technical solutions in the present disclosure more clearly, accompanying drawings to be used in some embodiments of the present disclosure will be introduced briefly below. Obviously, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams, and are not limitations on an actual size of a product, an actual process of a method and an actual timing of a signal involved in the embodiments of the present disclosure.

DETAILED DESCRIPTION

Figure 1:
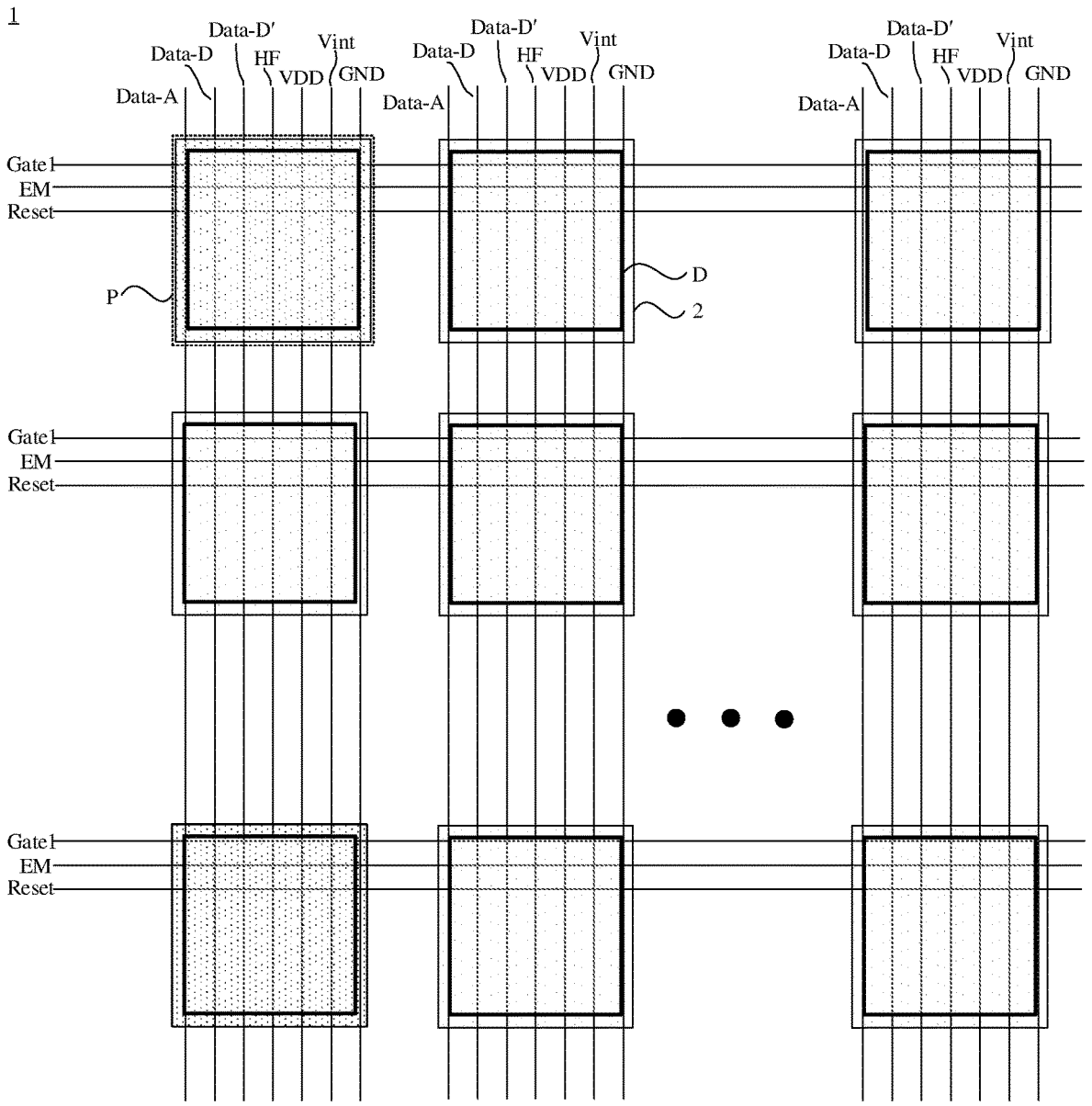
FIG. 1 is a diagram showing a structure of a display panel, in accordance with some embodiments of the present disclosure.

Technical solutions in some embodiments of the present disclosure will be described clearly and completely with reference to the accompanying drawings below. Obviously, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as open and inclusive, i.e., "including, but not limited to." In the description of the specification, the terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

Hereinafter, the terms "first" and "second" are only used for descriptive purposes, and are not to be construed as indicating or implying the relative importance or implicitly indicating the number of indicated technical features. Thus, features defined as "first" and "second" may explicitly or implicitly include one or more of the features. In the description of the embodiments of the present disclosure, "a plurality of" the plurality of means two or more unless otherwise specified.

In the description of some embodiments, the terms such as "coupled" and "connected" and their derivatives may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. However, the term "coupled" or "communicatively coupled" may also mean that two or more components are not in direct contact with each other, but still cooperate or interact with each other. The embodiments disclosed herein are not necessarily limited to the contents herein.

The phrase "at least one of A, B and C" has a same meaning as the phrase "at least one of A, B or C", and they both include the following combinations of A, B and C: only A, only B, only C, a combination of A and B, a combination of A and C, a combination of B and C, and a combination of A, B and C.

The phrase "A and/or B" includes the following three combinations: only A, only B, and a combination of A and B.

As used herein, the term "if" is optionally construed as "when" or "upon" or "in response to determining" or "in response to detecting", depending on the context. Similarly, the phrase "if it is determined" or "if [a stated condition or event] is detected" is optionally construed to mean "upon determining" or "in response to determining" or "upon detecting [the stated condition or event]" or "in response to detecting [the stated condition or event]", depending on the context.

The use of the phrase "adapted to" or "configured to" herein is meant as open and inclusive language that does not foreclose devices adapted to or configured to perform additional tasks or steps.

In addition, the use of "based on" is meant to be open and inclusive, since in that a process, step, calculation, or other action "based on" one or more recited conditions or values may, in practice, be based on additional conditions or values beyond those recited.

Terms such as "about" or "approximately" as used herein is inclusive of a stated value and an average value within an acceptable range of deviation of a particular value. The acceptable range of deviation is determined by a person of ordinary skill in the art in view of the measurement in question and the error associated with a particular amount of measurement (i.e., the limitations of the measurement system).

As used herein, same reference numerals denote both corresponding signal terminals and corresponding signals.

Exemplary embodiments are described herein with reference to sectional views and/or plan views as idealized exemplary drawings. In the drawings, thicknesses of layers and regions are exaggerated for clarity. Therefore, variations in the shape with respect to the drawings due to, for example, manufacturing technology and/or tolerances may be envisaged. Therefore, the exemplary embodiments should not be construed as being limited to the shape of the area shown herein, but include shape deviations due to, for example, manufacturing. For example, the etched area shown as a rectangle generally has curved features. Therefore, the areas shown in the drawings are schematic in nature, and their shapes are not intended to show the actual shape of the area of the device, and are not intended to limit the scope of the exemplary embodiments.

In the field of display technologies, a micro-LED display device and a mini-LED display device have advantages of high brightness and wide color gamut, and thus they may be more widely applied in the display field in the future.

Referring to FIG. 1, the Micro-LED display device and the Mini-LED display device, for example, both include a display panel 1. The display panel 1 includes a plurality of sub-pixels P and a plurality of signal lines. In each sub-pixel P, a pixel circuit 2 and an element to be driven D coupled to the pixel circuit 2 are provided. The plurality of signal lines are configured to provide the pixel circuit 2 with a variety of signals for use. The element to be driven D is, for example, a current-type element to be driven D, further, it may be a current-type light-emitting diode. For example, the element to be driven D is a Micro light-emitting diode (Micro-LED), a Mini light-emitting diode (Mini-LED), an organic light-emitting diode (OLED), or a quantum dot light-emitting diode (QLED). In this case, a working time of the element to be driven D described below may be regarded as a light emission time of the element to be driven D. That the element to be driven D works may be regarded as that the element to be driven D emits light, a first electrode and a second electrode of the element to be driven D may be regarded as an anode and a cathode of a light-emitting diode, and that a driving signal is transmitted to the element to be driven D may be regarded as that a driving current Id is transmitted to the element to be driven D.

For example, referring to FIG. 1, the plurality of data lines include a first gate line Gate1, a light emission control signal line EM, a reset signal line Reset, a data signal line Data-A, a first control signal line Data-D, a second control signal line HF, a third control signal line Data-D', an initialization signal line Vinit, a first power supply voltage signal line VDD and a ground line GND. The signal lines are coupled to corresponding signal terminals in the pixel circuit 2, and a variety of signals are provided to the pixel circuit 2 through the signal terminals by the signal lines.

Pixel circuits 2 in a same row are coupled to a same first gate line Gate1, a same light emission control signal line EM and a same reset signal line Reset.

Pixel circuits 2 located in a same column are coupled to a same data signal line Data-A, a same first control signal line Data-D, a same second control signal line HF, a same third control signal line Data-D', a same initialization signal line Vinit, a same first power supply voltage signal line VDD and a same ground line GND.

Based on this, referring to FIGS. 2A to 2D, some embodiments of the present disclosure provide a pixel circuit 2 including an input circuit 21 and a time control circuit 22.

The input circuit 21 includes a driving transistor DTFT, and the input circuit 21 is configured to write a data signal provided by a data signal terminal Data-A to a gate of the driving transistor DTFT in response to a first gate signal provided by a first gate signal terminal Gate1, so that the driving transistor DTFT outputs a driving signal used for driving the element to be driven D to emit light, according to a gate voltage of the driving transistor DTFT and a source voltage of the driving transistor DTFT.

In some embodiments, the driving transistor DTFT is, for example, a P-type or an N-type metal-oxide-semiconductor (MOS) field-effect transistor, or a P-type or an N-type thin film transistor. The driving transistor DTFT includes a gate, a first electrode and a second electrode. The first electrode and the second electrode are, for example, a source and a drain, respectively, and vice versa. The driving signal output by the driving transistor DTFT is, for example, a driving current $I_d$, and $I_d=K\times(V_{gs}-V_{th})^2$, where K is a constant, $V_{gs}$ is a difference between the gate voltage and source voltage of the driving transistor DTFT ($V_{gs}=V_g-V_s$), $V_g$ is the gate voltage of the driving transistor DTFT, $V_s$ is the source voltage of the driving transistor DTFT, and $V_{th}$ is a threshold voltage of the driving transistor DTFT.

Since luminance of the element to be driven D is related to the light emission duration and the driving current Id thereof when the element to be driven D emits light, the luminance of the element to be driven D may be controlled by adjusting the light emission duration and/or the driving current $I_d$ of the element to be driven D. For example, if two elements to-be-driven D have the same driving current $I_d$ and different light emission durations, luminances thereof are different; if the two elements to-be-driven D have different driving currents Id and the same light emission duration, the luminances thereof are different; if the two elements to-be-driven D have different driving currents Id and different light emission durations, a detailed analysis is required as to whether the luminances of the two elements D to be driven are the same or not.

The time control circuit 22 is coupled to the input circuit 21 and is configured to be coupled to the element to be driven D, and the control circuit 22 is further configured to: control the input circuit 21 to transmit the driving signal to the element to be driven D for a first duration T1, in response to a first control signal provided by a first control signal terminal Data-D; and control the input circuit 21 to transmit the driving signal to the element to be driven D for a second duration T2, in response to a second control signal provided by a second control signal terminal HF. The second duration T2 is shorter than the first duration T1, and the second duration T2 includes a plurality of time periods t' that are spaced apart.

Those skilled in the art may understand that the first duration T1 and the second duration T2 are both the working time of the element to be driven D, that is, the light emission durations of the element to be driven D.

For example, the first duration T1 is continuous, that is, it includes only one time period. The second duration T2 is discontinuous, that is, it includes the plurality of time periods t' that are spaced apart. A duration between two adjacent time periods t' is a non-working duration of the element to be driven D, that is, the element to be driven D does not emit light in this duration.

Figure 2A:
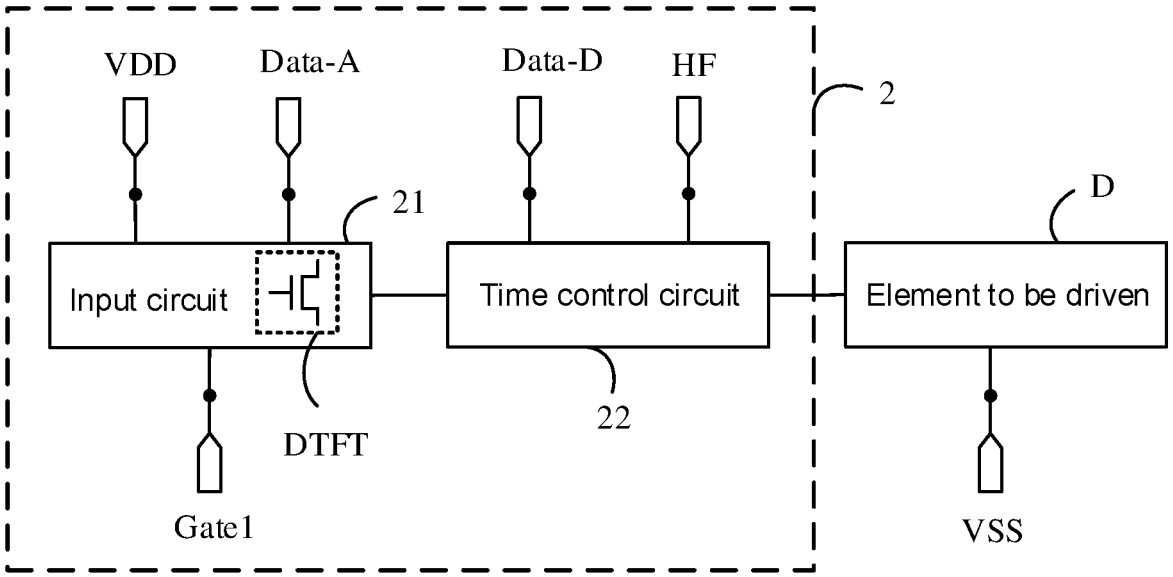
FIG. 2A is a diagram showing a structure of a pixel circuit, in accordance with some embodiments of the present disclosure.

For example, referring to FIG. 2A, which illustrates structures of the pixel circuit 2 and the element to be driven D, in a process of outputting the driving signal by the input circuit 21, if the time control circuit 22 receives the first control signal, the driving signal is transmitted to the element to be driven D for the first duration T1, that is, the light emission duration of the element to be driven D is the first duration T1. If the time control circuit 22 receives the second control signal, the driving signal is transmitted to the element to be driven D for the second duration T2, and the second duration includes the time periods t'. That is, the light emission duration of the element to be driven D is the second duration T2. In this way, the time control circuit 22 may control a duration in which the driving signal is transmitted to the element to be driven D according to the first control signal and the second control signal.

Based on the above, before the display device displays an image, a driving chip analyzes the image to be displayed to obtain a gray scale of an element to be driven D in each sub-pixel P corresponding to the image in advance. When the image is displayed, the driving chip supplies the corresponding data signal, the corresponding first control signal and the corresponding second control signal to the pixel circuit 2, according to a gray scale corresponding to the element to be driven D, so as to control the luminance of the element to be driven D. Here, the gray scales are obtained by dividing values between a maximum luminance and a minimum luminance into several levels. That is, a magnitude of a gray scale corresponds to a luminance in a one-to-one correspondence, and the higher the gray scale is, the greater the luminance is. Therefore, the gray scale may be used to measure a luminance.

For example, when the element to be driven D needs to display a medium gray scale or a high gray scale, the driving chip provides the element to be driven D with the first control signal, so as to control the element to be driven D to emit light for the first duration T1; when the element to be driven D needs to display a low gray scale, the driving chip provides the element to be driven D with the second control signal, so as to control the element to be driven D to emit light for the second duration T2.

Since the first duration T1 is longer than the second duration T2, a long light emission duration and a small driving current are adopted in the embodiments of the present disclosure when the medium gray scale and the high gray scale are displayed, so as to reduce a power consumption of the display panel 1 and protect the driving transistor DTFT; whereas when the low gray scale is displayed, a large driving current and a short light emission duration are adopted in the embodiments of the present disclosure, so as to ensure that the element to be driven D works stably.

It will be noted that, the driving current for the medium gray scale and the high gray scale is definitely greater than the driving current for the low gray scale. The large driving current and the small driving current are compared based on a low gray scale level versus a low gray scale level, or a medium gray scale level and a high gray scale level versus a medium gray scale level and a high gray scale level, rather than a low gray scale level versus a medium gray scale level or a high gray scale level. The low gray scale, medium gray scale and high gray scale may be provided by setting preset values in the driving chip in advance, and a range where a certain gray scale is located may be determined by comparing the gray scale with the preset value, so as to ensure that the driving chip is capable of determining that the gray scale belongs to the low gray scale, the medium gray scale or the high gray scale, and then, according to the result, the driving chip determines to provide the first control signal or the second control to the element to be driven D.

For example, a gray scale range that can be displayed by the element to be driven D is 0 to 255. When a certain gray scale is in a range of 0 to 30, it belongs to a low gray scale; when a certain gray scale is in a range of 31 to 170, it belongs to a medium gray scale; and when a certain gray scale is in a range of 171 to 255, it belongs to a high gray scale.

On this basis, for another example, when a gray scale to be displayed by the element to be driven D belongs to a medium gray scale or a high gray scale, the time control circuit 22 responds to the first control signal; and when a gray scale to be displayed by the element to be driven D belongs to a low gray scale, the time control circuit 22 responds to the second control signal.

Figure 3A:
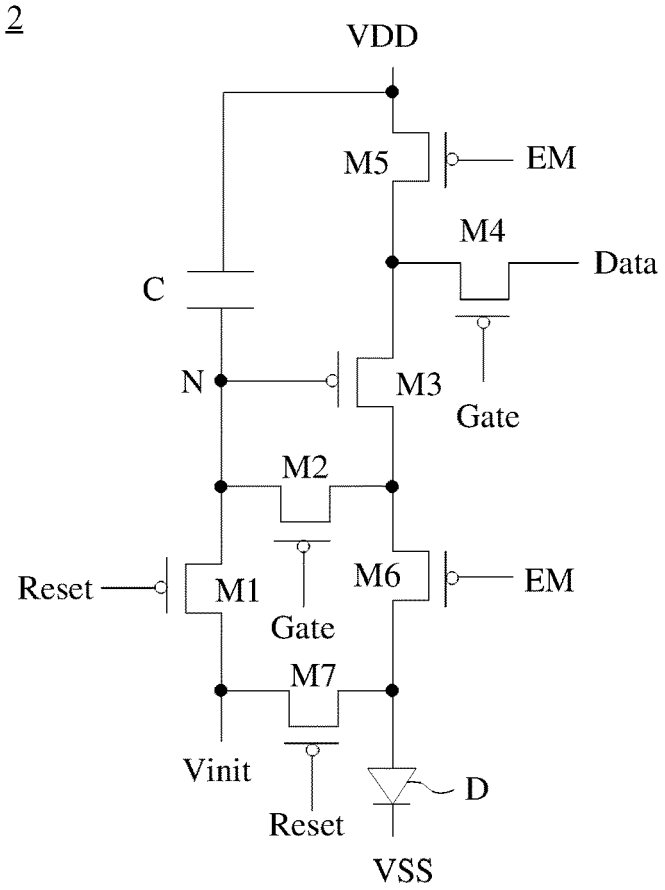
FIG. 3A is a diagram showing a structure of a pixel circuit in the related art.

In the related art, referring to FIG. 3A, the pixel circuit 2 includes a transistor M1, a transistor M2, a transistor M3, a transistor M4, a transistor M5, a transistor M6, a transistor M7 and a capacitor C, and the transistor M3 is the driving transistor DTFT.

A gate of the transistor M1 is coupled to a reset signal terminal Reset, a first electrode of the transistor M1 is coupled to an initialization signal terminal Vinit, and a second electrode of the transistor M2 is coupled to a node N.

A gate of the second transistor M2 is coupled to a gate signal terminal Gate, a first electrode of the second transistor M2 is coupled to a second electrode of the transistor M3, and a second electrode of the second transistor M2 is coupled to the node N.

A gate of the transistor M3 is coupled to the node N, a first electrode of the transistor M3 is coupled to a second electrode of the fourth transistor M4, and a second electrode of the transistor M3 is coupled to a first electrode of the transistor M6.

A gate of the transistor M4 is coupled to the gate signal terminal Gate, a first electrode of the transistor M4 is coupled to a data signal terminal Data.

A gate of the fifth transistor M5 is coupled to a light emission control terminal EM, a first electrode of the fifth transistor M5 is coupled to a first power supply voltage signal terminal, a second electrode of the fifth transistor M5 is coupled the first electrode of the transistor M3.

A gate of the transistor M6 is coupled to the light emission control terminal EM, and a second electrode of the transistor M6 is coupled to an anode of the element to be driven D.

A gate of the seventh transistor M7 is coupled to the reset signal terminal, a first electrode of the seventh transistor T7 is coupled to the initialization signal terminal Vinit, and a second electrode of the seventh transistor T7 is coupled to the anode of the element to be driven D.

A terminal of the capacitor C is coupled to the node N, and another terminal of the capacitor C is coupled to the first power supply voltage signal terminal VDD. A cathode of the element to be driven D is coupled to a second power supply voltage signal terminal VSS.

The time for the display panel 1 to display a frame of image (i.e., a frame period) is related to a refresh frequency thereof. For example, when the refresh frequency of the display panel 1 is 60 HZ, the time for displaying one frame of image is 1/60 s. The display panel 1 utilizes a line scanning technique, and when the display panel 1 displays an image, from pixel circuits 2 in a first row of the display panel to drive the elements D to be driven to emit light to pixel circuits 2 in a last row to drive the elements to be driven to emit light, the total time is 1/60 s, and thus time assigned to the pixel circuits 2 in each row is related to the number of rows in the display panel 1. For ease of description, hereinafter, a total process in which a pixel circuit 2 drives an element to be driven D to emit light is called a driving period, and a duration of the driving period is equal to 1/N of the time for displaying one frame of image. N is the number of pixel rows in the display panel.

Figure 3B:
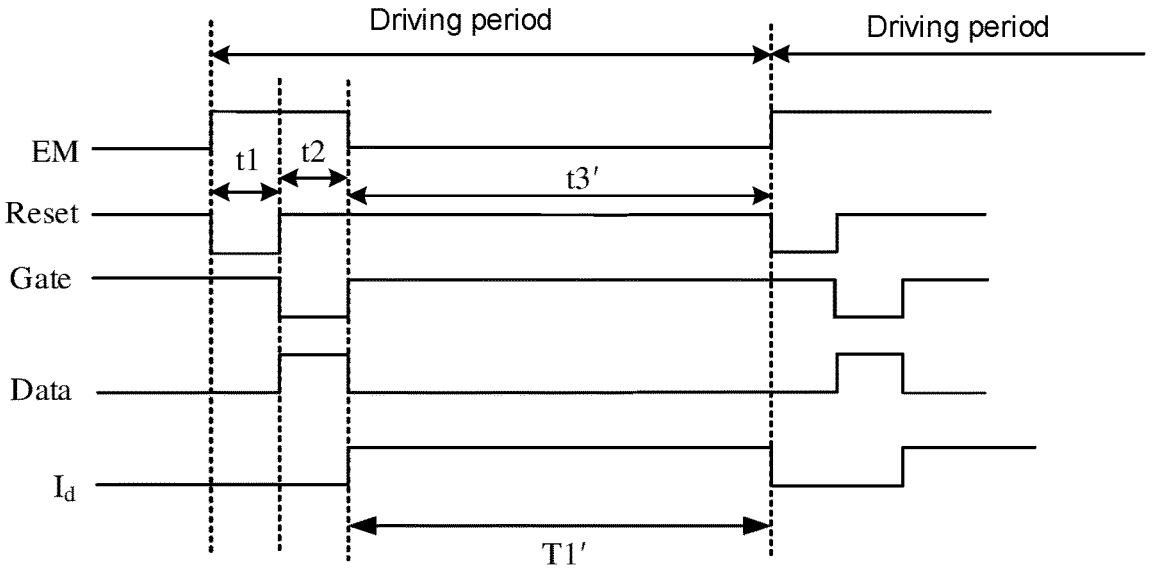
FIG. 3B is a timing diagram of a pixel circuit displaying a medium gray scale and a high gray scale in the related art.
Figure 3C:
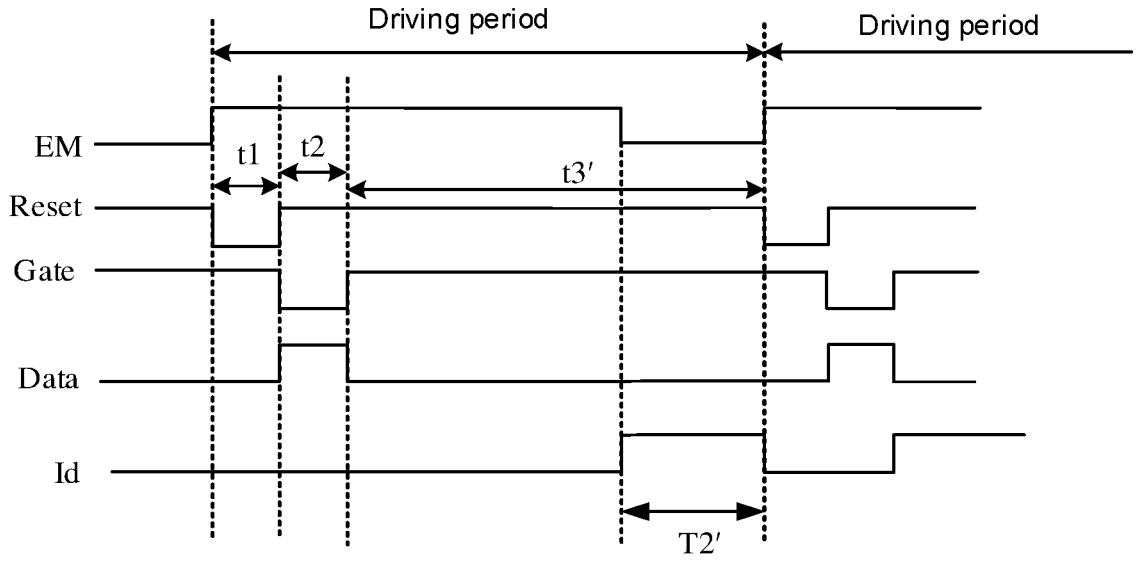
FIG. 3C is a timing diagram of a pixel circuit displaying a low gray scale in the related art.

For the structure shown in FIG. 3A, in combination with FIGS. 3B and 3C, a working process of the pixel circuit 2 in a driving period includes, for example, the following periods.

In a reset period t1, the transistor M1 and the transistor M7 are turned on under the control of a reset signal provided by the reset signal terminal Reset, so as to transmit an initialization signal provided by the initialization signal terminal Vinit to the gate of the driving transistor M3 and the anode of the element to be driven D to reset.

In a data-writing period t2, the transistor M2 and the transistor M4 are turned on under the control of the gate signal Gate provided by the gate signal terminal Gate, so as to transmit the data signal provided by the data signal terminal Data to the gate of the transistor M3 through the transistor M4, the transistor M3 and the transistor M2, and charge the capacitor C. At this time, the transistor M3 is in a self-saturation state, that is, a difference between the gate voltage and the source voltage of the third transistor M3 is equal to the threshold voltage of the third transistor M3.

In a light-emitting period t3', the transistor M5 and the transistor M6 are turned on under the control of the light emission control signal provided by the light emission control signal terminal EM. The capacitor C starts to discharge, so that the gate voltage of the transistor M3 is further boosted, and the transistor M3 is turned on. Accordingly, the driving signal is transmitted to the element to be driven D, so that the element to be driven D starts to emit light. The driving signal is, for example, a driving current $I_d$, and a magnitude of the driving current $I_d$ is related to the gate voltage of the transistor M3 and a first power supply voltage provided by the first power supply voltage signal terminal VDD.

In the related art, when a medium gray scale and a high gray scale are displayed, a timing diagram of the pixel circuit 2 is as shown in FIG. 3B. In the light-emitting period t3', the light emission control signal is maintained an active signal (a low level), and thus a light emission duration T1' of the element to be driven D is equal to a duration of the light-emitting period t3', such as 1000 microseconds (μs). In this process, if the element to be driven D needs to display the medium gray scale or the high gray scale, luminance thereof is relatively large. Therefore, the pixel circuit 2 adopts a small driving current together with a long light emission duration T1' for display.

In the related art, when the low gray scale display is displayed, a timing diagram of the pixel circuit 2 is as shown in FIG. 3C. In the light-emitting period t3', the light emission control signal includes both an active signal (a low level) and an inactive signal (a high level), and a light emission duration T2' of the element to be driven D is shorter than a duration of the light-emitting period t3'. The light-emitting duration T2' is, for example, 10 microseconds, and the duration of the light-emitting period t3' is, for example, 1000 microseconds. In this process, if the element to be driven D needs to display the low gray scale, the luminance thereof is relatively small. Therefore, the pixel circuit 2 adopts a large driving current together with a short light emission duration.

Those skilled in the art may understand that, when the display panel 1 displays images, the time allocated to each frame of image is in a reciprocal relationship to the refresh frequency of the display panel, and in a frame of image, each element to be driven D only emits light in the light-emitting period t3', whereas it does not emit light in the reset period t1 and the data-writing period t2 (that is, the element to be driven D is in a dark state). However, the duration of the light-emitting period t3' is not always equal to the light emission duration. In FIG. 3C, the light emission duration T2' only accounts for part of the light-emitting period t3', and the element to be driven D is in a dark state during the rest of the light-emitting period t3'. Accordingly, when the low gray scale is displayed, a total time of a continuous dark state of the element to be driven D (including non-light-emitting periods in the reset period t1, the data-writing period t2 and the light-emitting period t3') is longer than a total time of a continuous dark state of the element to be driven D (including the reset period t1 and the data-writing period t2) when the medium gray scale and the high gray scale are displayed.

On a basis of the related art, first, it can be seen from the working process of the pixel circuit 2 that, as long as the light emission control signal is an active signal, the transistor M3 will continuously transmit the driving signal to the element to be driven D. However, as shown in FIG. 3C, in the light-emitting period t3', the light emission control signal includes both an active signal (a low level) and an inactive signal (a high level), and thus the light emission duration T2' is relatively small. Since the light-emitting period t3' accounts for the largest proportion of the driving period, the shorter the light emission duration T2' is, the shorter the time that the element to be driven D continuously emits light (also referred to as concentrated light emission) is. Therefore, the total time that the element to be driven D is in the dark state is longer during the overall driving period. Due to the visual delay effect of the human eyes, if the time that the element to be driven D is in the dark state is relatively short between two adjacent frames of image, the human eyes are incapable of perceiving a turning of the element to be driven D from bright to dark between two adjacent frames of image, and thus it is considered that there is no turning of the element to be driven D between the two adjacent frames of image. However, if the time that the element to be driven D is in the dark state is relatively long, the human eyes are capable of perceiving the turning of the element to be driven D from bright to dark between the two adjacent frames of image, so that a flicker between the two adjacent frames of image may be perceived. As a result, since the light emission duration T2' of the element to be driven D is relatively short when the low gray scale is displayed, there is a flicker problem in the related art, which may affect a display effect of the display panel 1 and a user's viewing experience.

Second, referring to FIGS. 3A, 3B and 3C, in the pixel circuit 2, the duration of the light-emitting period t3' depends on a duration of the active signal of the light emission control signal. That is, in the pixel circuit 2, whether the element to be driven D displays the low gray scale, the medium gray scale or the high gray scale, the light emission duration thereof is determined by the light emission control signal. In addition, as shown in FIG. 3C, the active signal of the light emission control signal only lasts for T2' in the light-emitting period t3', so that the element to be driven D only continuously emits light in the time period of T2' when the low gray scale is displayed.

However, in the embodiments of the present disclosure, the pixel circuit 2 includes the time control circuit 22, which is coupled to the input circuit 21 and the element to be driven D; and the time control circuit 22 is configured to: control the input circuit 21 to transmit the driving signal to the element to be driven D for the first duration T1 in response to the first control signal provided by the first control signal terminal Data-D; and control the input circuit 21 to transmit the driving signal to the element to be driven D for the second duration T2 in response to the second control signal provided by the second control signal terminal HF. The second duration T2 includes the plurality of time periods t' spaced apart from each other. Compared with the pixel circuit 2 in the related art, firstly, the time control circuit 22 is added to the pixel circuit 2 in the embodiments of the present disclosure, and the time control circuit 22 is configured to control the light emission duration of the element to be driven D to be the second duration T2 in response to the second control signal, and the second duration T2 includes the time periods t'. Since the second duration T2 is divided into a plurality of time periods t', and the element to be driven D emits light during each of the time periods t', the way that the element to be driven D displays the low gray scale changes from a continuous light-emission in the related art to an intermittent light-emission. During the intermittent light-emission, human eyes are incapable of perceiving the turning of the element to be driven D from bright to dark, and thus it is considered that the element to be driven D keeps emitting light. Accordingly, the light emission duration T2 of the element to be driven D is visually prolonged, and the continuous dark state time of the element to be driven D is reduced, so that the flicker problem may be avoided during the process of switching between the two adjacent frames of image. Secondly, in the pixel circuit 2 of the embodiments of the present disclosure, the light emission duration of the element to be driven D is controlled by the time control circuit 22, which may accurately control the light emission duration of the element to be driven D according to a gray scale range of a gray scale to be displayed, so that the flicker problem, which occurs during the element to be driven D displaying the low gray scale, is improved. In this way, the display effect of the display panel 1 and the user's experience are improved.

Figure 2B:
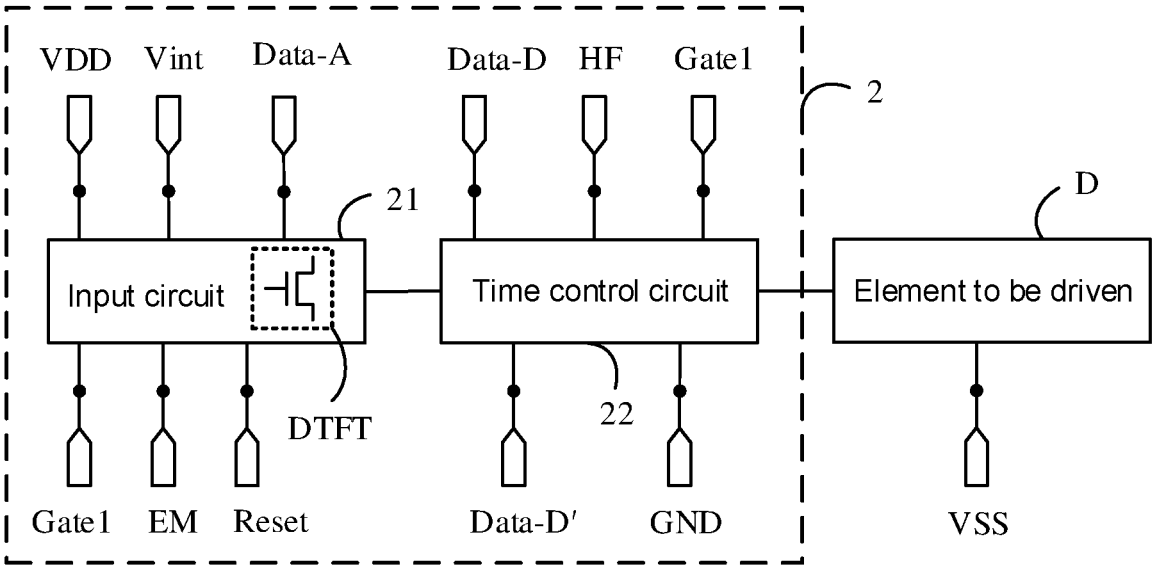
FIG. 2B is a diagram showing a structure of another pixel circuit, in accordance with some embodiments of the present disclosure.

In some embodiments, referring to FIG. 2B, the time control circuit 22 is further configured to: control the input circuit 21 to transmit the driving signal to the element to be driven D for the first duration T1 in response to the first gate signal; and control the input circuit 21 to transmit the driving signal to the element to be driven D for the second duration T2 in response to the first gate signal and a third control signal provided by a third control signal terminal Data-D'. The third control signal and the first control signal are mutually inverted signals.

Referring to FIG. 2B, under the control of the first control signal and the first gate signal, the time control circuit 22 controls the input circuit 21 to transmit the driving signal to the element to be driven D for the first duration T1. Under the control of the second control signal, the first gate signal and the third control signal, the time control circuit 22 controls the input circuit 21 to transmit the driving signal to the element to be driven D for the second duration T2.

Since the third control signal and the first control signal are mutually inverted signals, when the third control signal is an active signal, the first control signal is an inactive signal. At this time, the time control circuit 22 needs to control the input circuit 21 to transmit the driving signal to the element to be driven D for the second duration T2, vice versa. Two mutually inverted signals are conducive to the control, so that the time control circuit 22 may accurately control a transmission duration of the driving signal to the element to be driven D, therefore, a signal crosstalk problem may be avoided.

Since the first gate signal may be used to control the input circuit 21, therefore, in a case where the first gate signal may also be used to control the time control circuit 22, the input circuit 21 and the time control circuit 22 may have a relatively good synchronization, which may avoid an inaccurate control caused by signal delay.

Figure 2C:
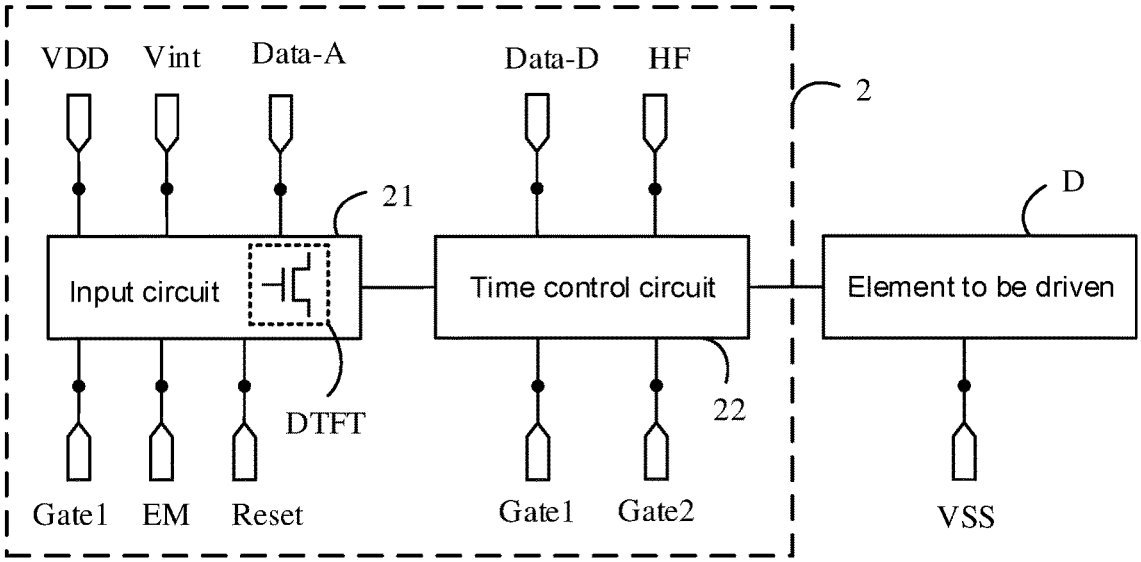
FIG. 2C is a diagram showing a structure of yet another pixel circuit, in accordance with some embodiments of the present disclosure.

In some other embodiments, referring to FIG. 2C, the time control circuit 22 is further configured to: control the input circuit 21 to transmit the driving signal to the element to be driven D for the first duration T1 in response to the first gate signal; and control the input circuit 21 to transmit the driving signal to the element to be driven D for the second duration T2. The second gate signal and the first gate signal are mutually inverted signals.

The time control circuit 22 controls the input circuit 21 to transmit the driving signal to the element to be driven D through the mutually inverted signals, i.e., the second gate signal and the first gate signal, which makes the control accurate and convenient.

Figure 2D:
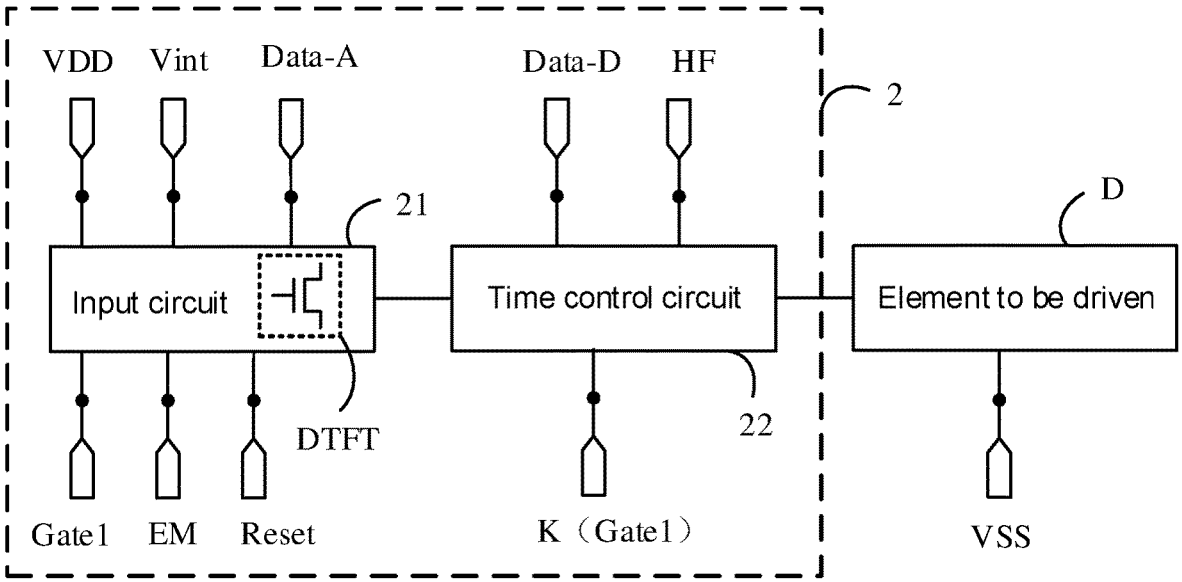
FIG. 2D is a diagram showing a structure of yet another pixel circuit, in accordance with some embodiments of the present disclosure.

In some embodiments, referring to FIG. 2D, the time control circuit 22 is further configured to receive the first control signal or the second control signal, in response to a fourth control signal K provided by a fourth control signal terminal K.

The fourth control signal K provided by the fourth control signal terminal K directly controls the time control circuit 22 to receive the first control signal or the second control signal, which may simplify a structure of the pixel circuit 2 and the control.

In some embodiments, referring to FIGS. 2B, 2C and 2D, the input circuit 21 is further configured to reset the gate of the driving transistor DTFT, or, both of the gate of the driving transistor DTFT and the anode of the element to be driven D, in response to the reset signal provided by the reset signal terminal Reset.

The reset for the gate of the driving transistor DTFT, or, for both of the gate of the driving transistor DTFT and the anode of the element to be driven D by the reset signal may ensure a potential at the gate of the driving transistor DTFT and a potential at the anode of the element to be driven D are accurate before the data-writing period t2, so as to prevent a residual data signal of a previous frame of image from affecting a current frame of image.

In some embodiments, referring to F IGS. 2B, 2C, and 2D, the input circuit 21 is further configured to control the first power supply voltage signal provided by the first power supply voltage signal terminal to transmit to the driving transistor DTFT, and control the driving signal to transmit to the time control circuit 22, in response to the light emission control signal provided by the light emission control signal terminal EM.

Since the driving signal output by the driving transistor DTFT is related to the first power supply voltage signal, by using the light emission control signal to control the transmission of the first power supply voltage signal to the driving transistor DTFT, and the on and off state between the driving transistor DTFT and the time control circuit 22, the transmission time of the driving signal to the time control circuit 22 is controlled, so as to make preparation for the control of the light emission duration of the element to be driven D by using the time control circuit 22.

Figure 4A:
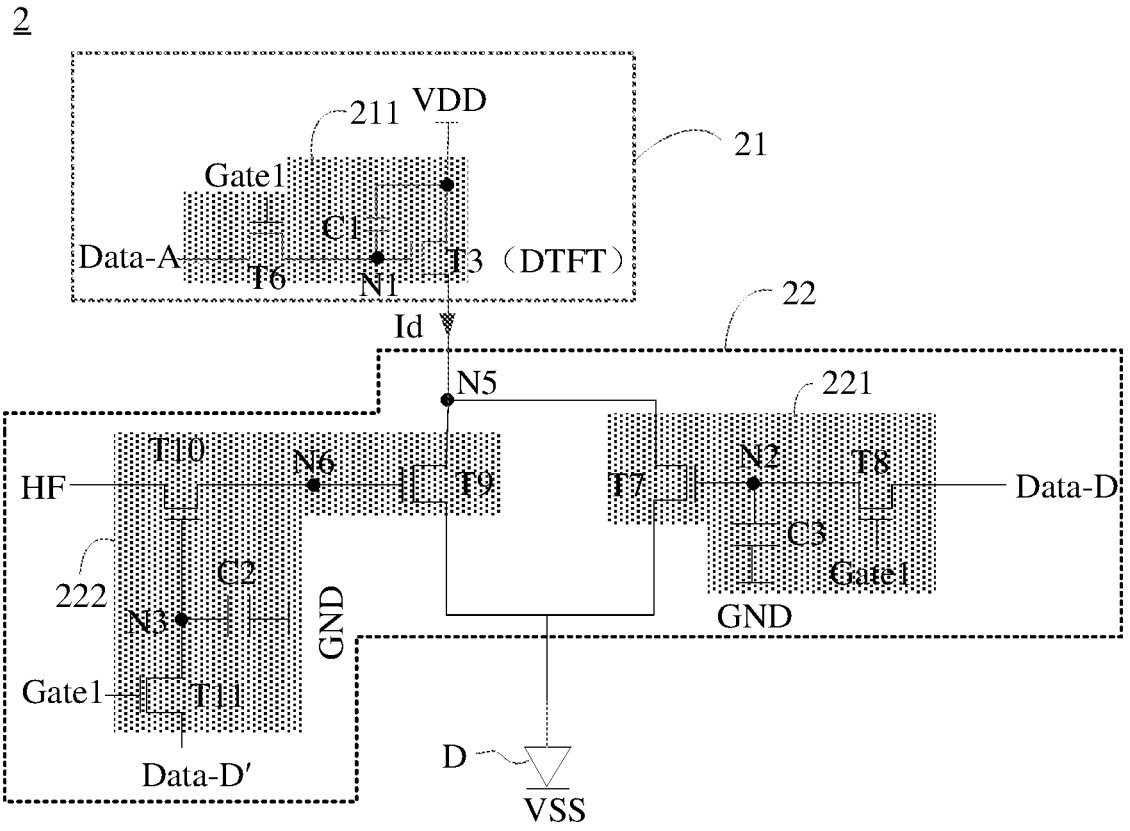
FIGS. 4A to 4G are diagrams each showing a structure of yet another pixel circuit, in accordance with some embodiments of the present disclosure.

In some embodiments, referring to FIG. 4A, the input circuit 21 includes a data-writing sub-circuit 211, and the data-writing sub-circuit 211 includes: a third transistor T3, a sixth transistor T6 and a first capacitor C1. The third transistor T3 is the driving transistor DTFT. A gate of the third transistor T3 is coupled to a first node N1, a first electrode of the third transistor T3 is coupled to the first power supply voltage signal terminal VDD, and a second electrode of the third transistor T3 is coupled to the time control circuit 22. A gate of the sixth transistor T6 is coupled to the first gate signal terminal Gate1, a first electrode of the sixth transistor T6 is coupled to the data signal terminal Data-A, and a second electrode of the sixth transistor T6 is coupled to the first node N1. A terminal of the first capacitor C1 is coupled to the first power supply voltage signal terminal VDD, and another terminal of the first capacitor C1 is coupled to the first node N1. The time control circuit 22 is further coupled to the anode of the element to be driven D, and the cathode of the element to be driven D is coupled to the second power supply voltage signal terminal VSS. For example, a voltage of a second power supply voltage signal VSS provided by the second power voltage signal terminal VSS is 0 V.

Referring to FIG. 4A, a working process of the input circuit 21 in the pixel circuit 2 includes, for example, a data-writing period and a light-emitting period. In the data-writing period, the sixth transistor T6 is turned on under the control of the first gate signal provided by the first gate signal terminal Gate1, so as to transmit the data signal Data-A provided by the data signal terminal Data-A to the first node N1, and charge the first capacitor C1. At this time, a potential at the first node N1 is equal to $V_{Data-A}$. In the light-emitting period, the sixth transistor T6 is turned off, the first node N1 is floating, the first capacitor C1 starts to discharge, the potential at the first node N1 keeps rising, and the third transistor T3 is turned on and starts to output the driving signal. For example, the driving signal is a driving current $I_d$.

Referring to FIG. 4A, in a case where the third transistor is a P-type transistor, a gate voltage thereof (i.e., the potential at the first node N1) is equal to $V_{Data-A}$, and a source thereof is coupled to the first power supply voltage signal terminal VDD, which makes a source voltage thereof equal to $V_{DD}$. As a result, $V_{gs}=V_{Data-A}-V_{DD}$. In a case where the third transistor is an N-type transistor, the gate voltage thereof is equal to $V_{Data-A}$, and the source thereof is coupled to a fifth node, which makes the source voltage thereof equal to a voltage $V_{N5}$ of the fifth node. As a result, $V_{gs}=V_{Data-A}-V_{N5}$.

Figure 4B:
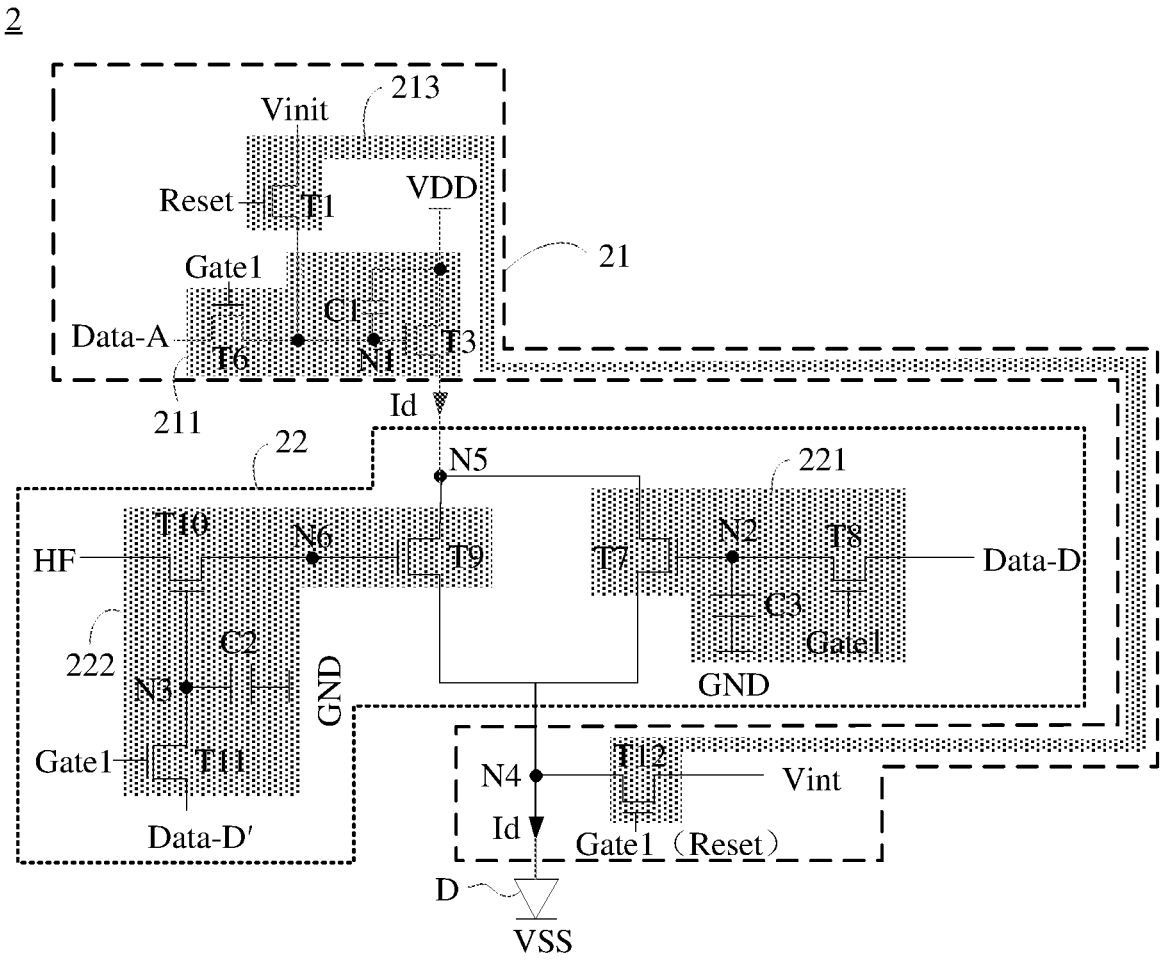

On this basis, referring to FIG. 4B, the input circuit 21 may further include a reset sub-circuit 213, and the reset sub-circuit 213 includes a first transistor T1, or a first transistor T1 and a twelfth transistor T12. A gate of the first transistor T1 is coupled to the reset signal terminal Reset, a first electrode of the first transistor T1 is coupled to the initialization signal terminal Vinit, and a second electrode of the first transistor T1 is coupled to the first node N1. A gate of the twelfth transistor T12 is coupled to the first gate signal terminal Gate1, a first electrode of the twelfth transistor T12 is coupled to the initialization signal terminal Vinit, and a second electrode of the twelfth transistor T12 is coupled to the anode of the element to be driven D. The first transistor T1 is configured to reset the first node N1, and the twelfth transistor T12 is configured to reset the anode of the element to be driven D.

The working process of the input circuit 21 may further include a reset period before the data-writing period. In the reset period, the first transistor T1 is turned on under the control of the reset signal, so as to transmit the initialization signal provided by the initialization signal terminal Vinit to the first node N1 to reset it. In a case where the reset sub-circuit 213 further includes the twelfth transistor T12, in the data-writing period, the twelfth transistor T12 is turned on under the control of the first gate signal, so as to transmit the initialization signal provided by the initialization signal terminal Vinit to the anode of the element to be driven D to reset it.

In some other embodiments, referring to FIG. 4B, the gate of the twelfth transistor T12 may be coupled to the reset signal terminal, so that the element to be driven D is reset under the control of the reset signal provided by the reset signal terminal Reset. This process is performed within the reset period.

Figure 4C:
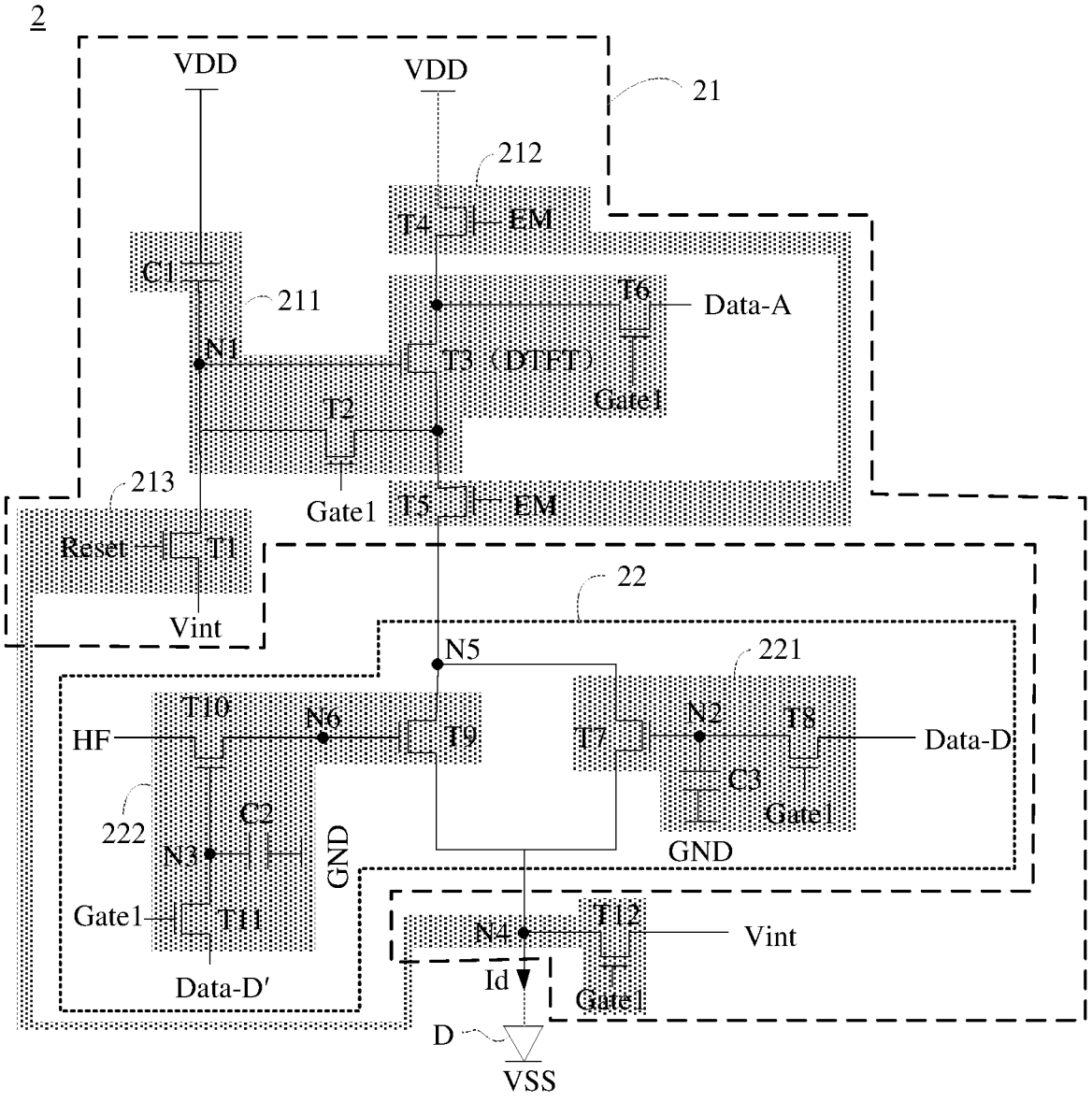

FIGS. 4A and 4B illustrate structures of the input circuit 21 provided by the embodiments of the disclosure, however, the input circuit 21 may also have the structure shown in FIG. 4C.

In some other embodiments, referring to FIG. 4C, the input circuit 21 includes a data-writing sub-circuit 211, and the data-writing sub-circuit 211 includes a second transistor T2, a third transistor T3, a sixth transistor T6 and a first capacitor C1. The third transistor T3 is the driving transistor DTFT. A gate of the second transistor T2 is coupled to the first gate signal terminal Gate1, a first electrode of the second transistor M2 is coupled to a second electrode of the third transistor T3, and a second electrode of the second transistor T2 is coupled to the first node N1. A gate of the third transistor T3 is coupled to the first node N1, a first electrode of the third transistor T3 is coupled to a second electrode of the sixth transistor T6, and the second electrode of the third transistor T3 is coupled to the fifth node N5; a gate of the sixth transistor T6 is coupled to the first gate signal terminal Gate1, a first electrode of the sixth transistor T6 is coupled to the data signal terminal Data-A, one terminal of the first capacitor C1 is coupled to the first node N1, and another terminal of the first capacitor C1 is coupled to the first power supply voltage signal terminal VDD.

Based on the structure in FIG. 4C, in the data-writing period of the pixel circuit 2, the sixth transistor T6 and the second transistor T2 are turned on under the control of the first gate signal terminal Gate1, so as to write the data signal $V_{Data-A}$ provided by the data signal terminal Data-A and a threshold voltage $V_{th}$ of the third transistor T3 to the first node N1 (i.e., the gate of the third transistor T3). In this case, the gate voltage $V_g$ of the driving transistor DTFT is equal to a sum of $V_{Data-A}$ and $V_{th}$ ($V_g=V_{Data-A}+V_{th}$), thereby compensating the threshold voltage $V_{th}$ of the driving transistor DTFT to the gate voltage thereof. It can be known from the above that, $I_d=K\times(V_{gs}-V_{th})^2$, and the driving current $I_d$ may be independent from the threshold voltage $V_{th}$ in the case where $V_g$ is equal to the sum of $V_{Data-A}$ and $V_{th}$ ($V_g=V_{Data-A}+V_{th}$), which may improve the stability of the driving transistor DTFT during its work, and reduce a difference between driving currents $I_d$ output by the driving transistor DTFT when different driving transistors DTFT receive a same data signal.

On this basis, in some embodiments, referring to FIG. 4C, the input circuit 21 further includes a light emission control sub-circuit 212, and the light emission control sub-circuit 212 includes a fourth transistor T4 and a fifth transistor T5. A gate of the fourth transistor T4 is coupled to the light emission control signal terminal EM, a first electrode of the fourth transistor T4 is coupled to the first power supply voltage signal terminal VDD, and a second electrode of the fourth transistor T4 is coupled to the first electrode of the third transistor T3 in the data-writing sub-circuit 211. A gate of fifth transistor T5 is coupled to the light emission control signal terminal EM, a first electrode of the fifth transistor T5 is coupled to the second electrode of the third transistor T3 in the data-writing sub-circuit 211, and a second electrode of the fifth transistor T5 is coupled to the time control circuit 22.

In this way, in the light-emitting period, the fourth transistor T4 is turned on under the control of the light emission control signal provided by the light emission control signal terminal EM, so as to transmit the first power supply voltage signal provided by the first power supply voltage signal terminal VDD to the first electrode of the third transistor T3. The fifth transistor T5 is turned on under the control of the light emission control signal provided by the light emission control signal terminal EM, so as to couple the input circuit 21 with the time control circuit 22.

On this basis, in some embodiments, referring to FIG. 4C, the input circuit 21 further includes a reset sub-circuit 213, and the reset sub-circuit 213 includes the first transistor T1, or the first transistor T1 and the twelfth transistor T12. The gate of the first transistor T1 is coupled to the reset signal terminal Reset, the first electrode of the first transistor T1 is coupled to the initialization signal terminal Vinit, and the second electrode of the first transistor T1 is coupled to the first node N1; the gate of the twelfth transistor T12 is coupled to the first gate signal terminal Gate1, the first electrode of the twelfth transistor T12 is coupled to the initialization signal terminal Vinit, and the second electrode of the twelfth transistor T12 is coupled to the anode of the element to be driven D. Here, that the second electrode of the twelfth transistor T12 is coupled to the anode of the element to be driven D may also be understood as that, the second electrode of the twelfth transistor T12 is coupled to the fourth node N4, and then the fourth node N4 is coupled to the anode of the element to be driven D.

Working periods and processes of the first transistor T1 and the twelfth transistor T12 have been described above, and will not be repeated here.

The structure of the input circuit 21 is described in detail above. However, the above structure is only used as an example to illustrate the structure of the input circuit 21, and does not constitute a limitation to the structure of the input circuit 21. Those skilled in the art may understand that, an input circuit 21 of other type may also be applicable to the present disclosure.

Figure 4D:
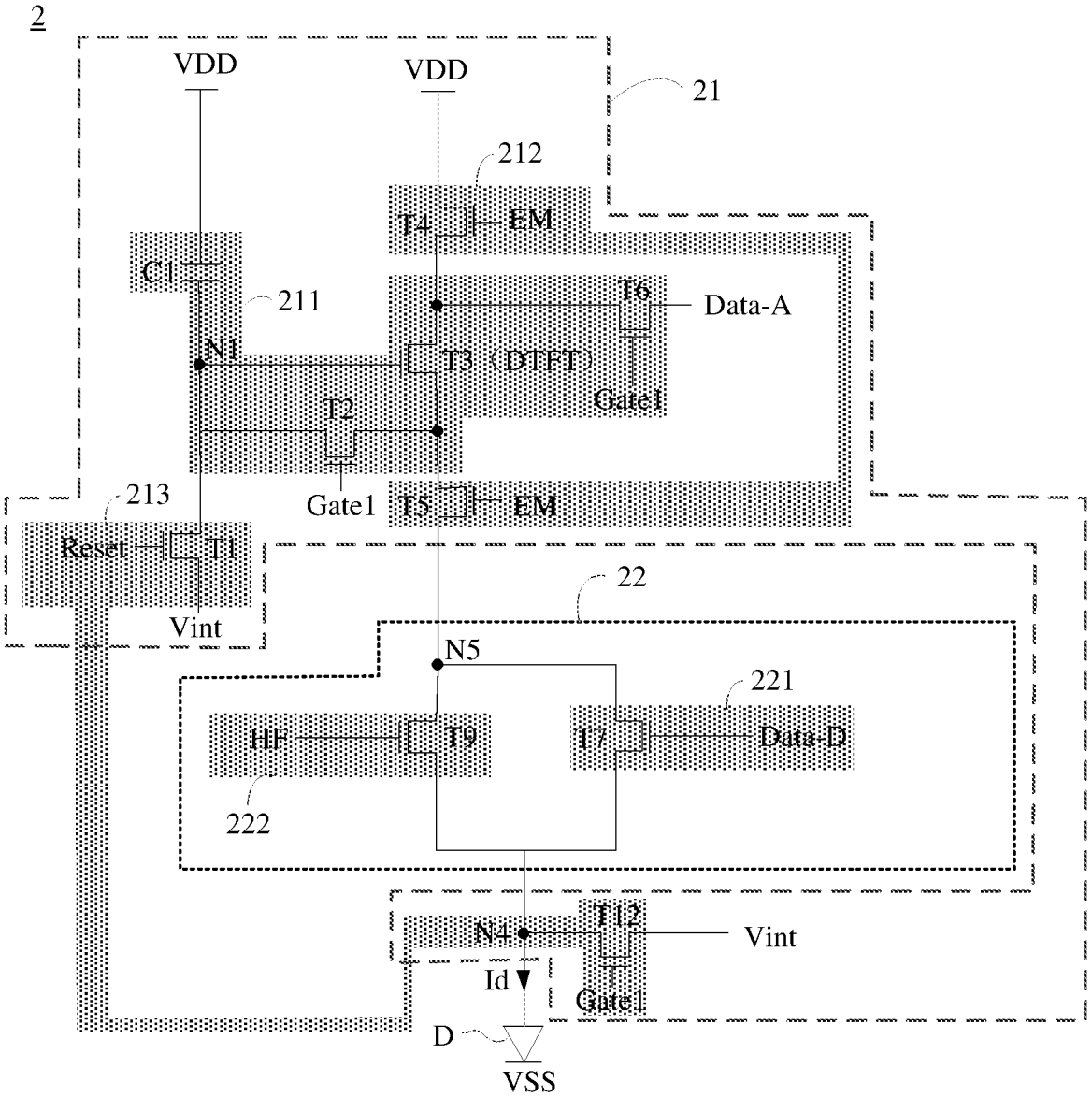

Hereinafter, the time control circuit 22 in the pixel circuit 2 is introduced. Referring to FIG. 4D, the time control circuit 22 in the embodiments of the present disclosure includes, for example, a first control sub-circuit 221 and a second control sub-circuit 222. The first control sub-circuit 221 includes a seventh transistor T7, and the second control circuit 222 includes a ninth transistor T9.

A gate of the seventh transistor T7 is coupled to the first control signal terminal Data-D, a first electrode of the seventh transistor T7 is coupled to the input circuit 21, and a second electrode of the seventh transistor T7 is coupled to the element to be driven D. A gate of the ninth transistor T9 is coupled to the second control signal terminal HF, a first electrode of the ninth transistor T9 is coupled to the input circuit 21, and a second electrode of the ninth transistor T9 is coupled to the element to be driven D.

In FIG. 4D, that the first electrode of the seventh transistor T7 and the first electrode of the ninth transistor T9 are coupled to the input circuit 21 may also be understood as that, the first electrode of the seventh transistor T7 and the first electrode of the ninth transistor T9 are coupled to the fifth node N5, and then the fifth node N5 is coupled to the input circuit 21. That the second electrode of the seventh transistor T7 is coupled to the element to be driven D and that the second electrode of the ninth transistor T9 is coupled to the element to be driven D may be understood as that, the second electrode of the seventh transistor T7 and the second electrode of the ninth transistor T9 are coupled to the fourth node N4, and then the fourth node N4 is coupled to the anode of the element to be driven D.

When the first control sub-circuit 221 is on, the light emission duration of the element to be driven D may be controlled to be the first duration T1. When the second control sub-circuit 222 is on, the light emission duration of the element to be driven D may be controlled to be the second duration T2.

Figure 4E:
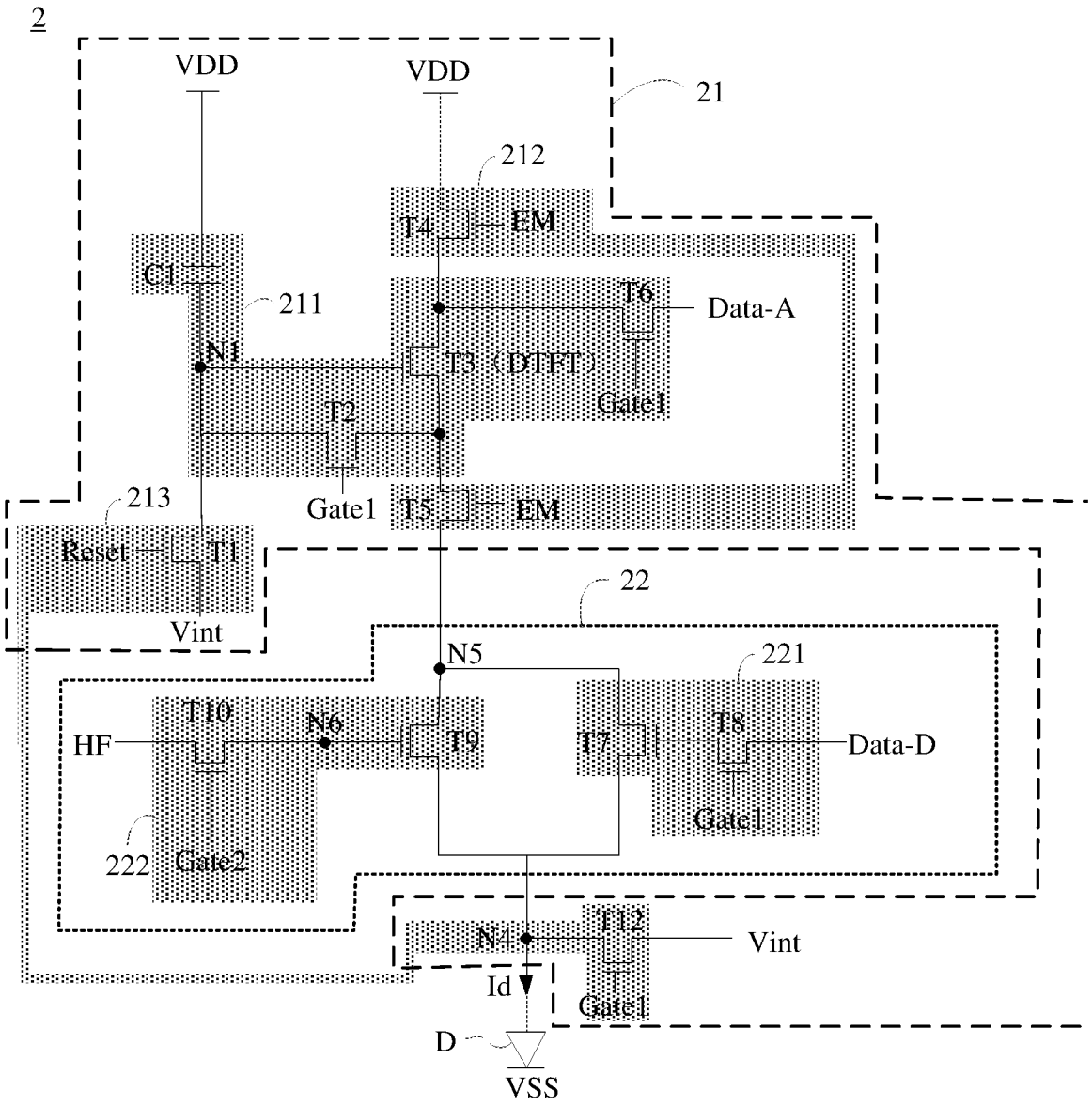
Figure 4F:
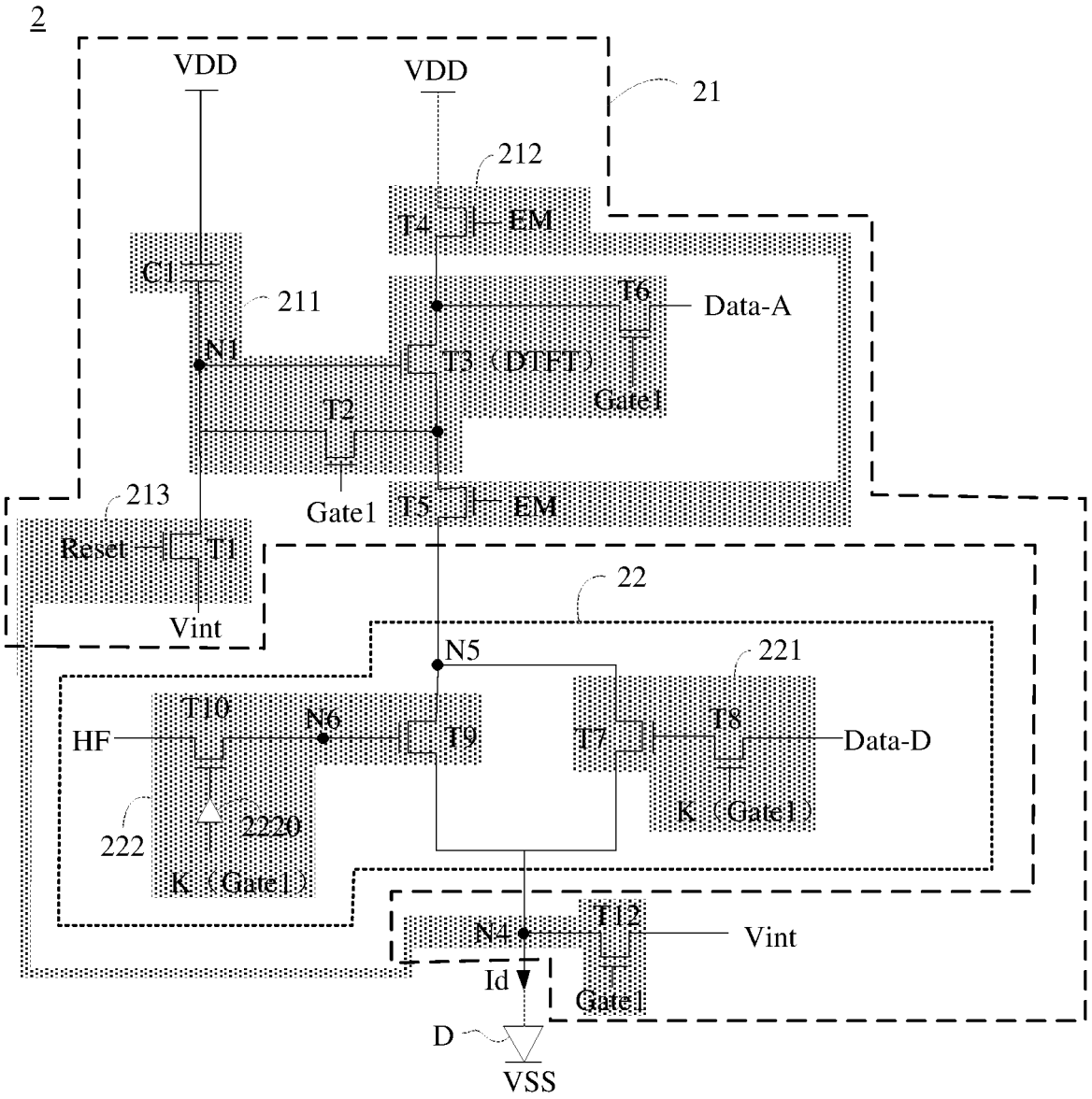

In some other embodiments, referring to FIGS. 4E and 4F, the time control circuit 22 may further include an eighth transistor T8 and a tenth transistor T10.

Referring to FIG. 4E, a gate of the eighth transistor T8 is coupled to the first gate signal terminal Gate1, a first electrode of the eighth transistor T8 is coupled to the first control signal terminal Data-D, and a second electrode of the eighth transistor T8 is coupled to the gate of the seventh transistor T7. A gate of the tenth transistor T10 is coupled to the second gate signal terminal Gate2, a first electrode of the tenth transistor T10 is coupled to the second control signal terminal HF, and a second electrode of the tenth transistor T10 is coupled to the gate of the ninth transistor T9. Signals from the second gate signal terminal Gate2 and the first Gate signal terminal Gate1 are mutually inverted signals. Since the signals are mutually inverted signals, the eighth transistor T8 and the tenth transistor T10 cannot be turned on simultaneously, and only one of the first control sub-circuit 221 and the second control sub-circuit 222 in the time control circuit 22 is turned on at a same time.

That the second electrode of the tenth transistor T10 is coupled to the gate of the ninth transistor T9 may also be understood as that, the second electrode of the tenth transistor T10 is coupled to the sixth node N6, and then the sixth node N6 is coupled to the gate of the ninth transistor T9, so that the second electrode of the tenth transistor T10 is coupled to the gate of the ninth transistor T9.

Referring to FIG. 4F, in some embodiments, the gate of the eighth transistor T8 is coupled to the fourth control signal terminal K, the first electrode of the eighth transistor T8 is coupled to the first control signal terminal Data-D, and the second electrode of the eighth transistor T8 is coupled to the gate of the seventh transistor T7. The gate of the tenth transistor T10 is coupled to an output terminal of an phase inverter 2220, the first electrode of the tenth transistor T10 is coupled to the second control signal terminal HF, and the second electrode of the tenth transistor T10 is coupled to the gate of the ninth transistor T9. The output terminal of the inverter 2220 is coupled to the fourth control signal terminal K.

The fourth control signal terminal K is configured to provide the gate of the eighth transistor T8 and the gate of the tenth transistor T10 with gate driving signals. Due to the inverter 2220 between the fourth control signal terminal K and the gate of the tenth transistor T10, the eighth transistor T8 and the tenth transistor T10 will not be turned on simultaneously under the control of the fourth control signal terminal K, which means only one of them is turned on.

In some embodiments, the fourth control signal provided by the fourth control signal terminal K may be the first gate signal. In some other embodiments, the fourth control signal provided by the fourth control signal terminal K may also be different from the first gate signal, which is not limited herein.

By controlling working states of the eighth transistor T8 and the tenth transistor T10 through the fourth control signal terminal K, it may be ensured that only one of the first control sub-circuit 221 and the second control sub-circuit 222 is turned on at a same time, and it is conducive to a reduction of the number of signal terminals in the pixel circuit 2.

Figure 4G:
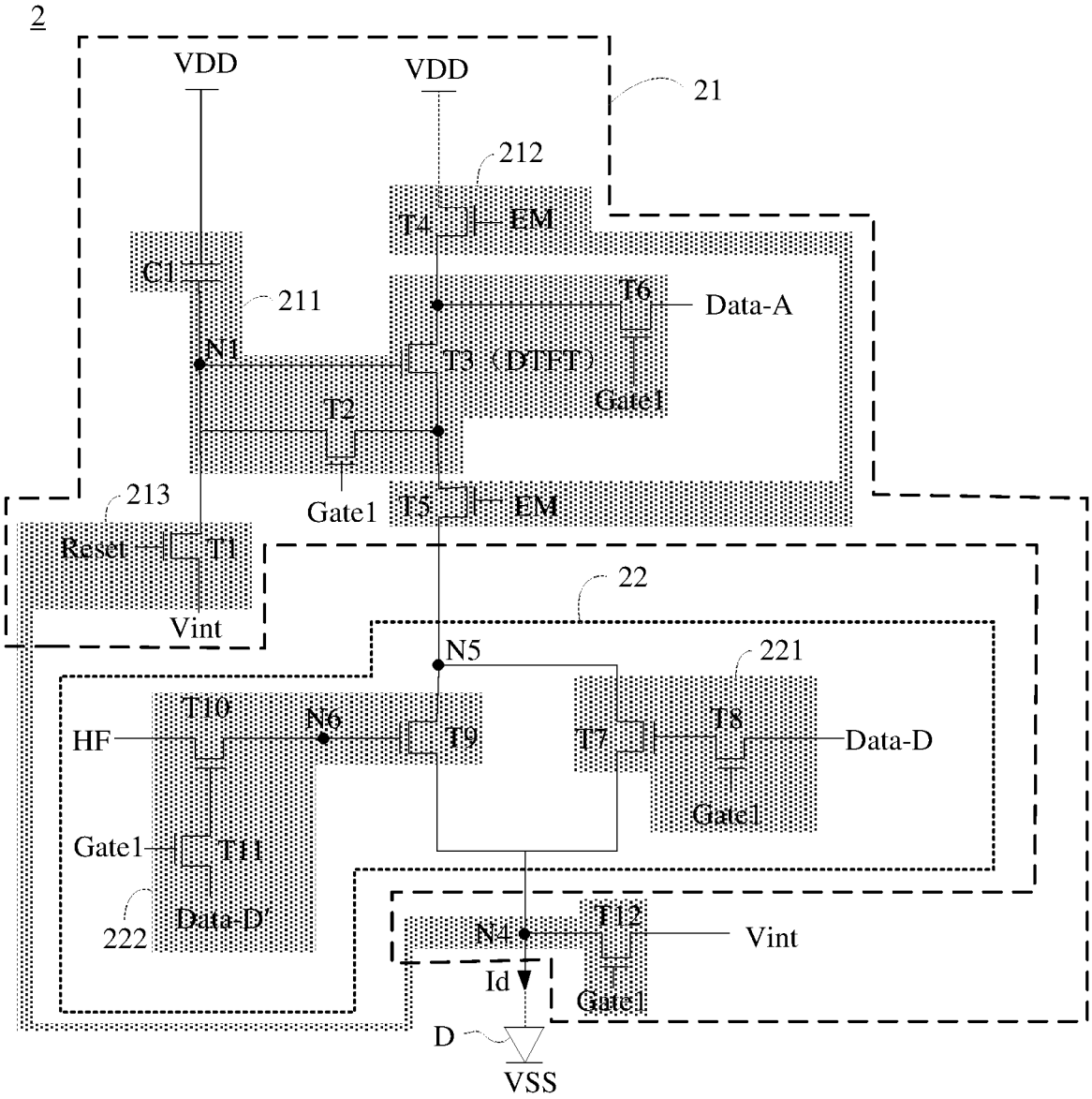

In some embodiments, referring to FIG. 4G, the time control circuit 22 further includes an eleventh transistor T11. A gate of the eleventh transistor T11 is coupled to the first gate signal terminal Gate1, a first electrode of the eleventh transistor T11 is coupled to the third control signal terminal Data-D', and a second electrode of the eleventh transistor T11 is coupled to the gate of the tenth transistor T10. The third control signal provided by the third control signal terminal Data-D' and the first control signal provided by the first control signal terminal Data-D are mutually inverted signals.

Since the gate of the eleventh transistor T11 and the gate of the eighth transistor T8 are both coupled to the first gate signal terminal Gate1, in a case where the first gate signal is an active signal, the eleventh transistor T11 and the eighth transistor T8 are both turned on. Since the third control signal and the first control signal are mutually inverted signals, the gate of the tenth transistor T10 and the gate of the seventh transistor T7 receive mutually inverted signals. As a result, the tenth transistor T10 and the seventh transistor T7 will not be turned on simultaneously. In addition, whether the second control signal is transmitted to the gate of the ninth transistor T9 depends on the tenth transistor T10. In this way, any one of the first control circuit 221 and the second control sub-circuit 222 may be selectively turned on by using the eighth transistor T8, the tenth transistor T10 and the eleventh transistor T11.

On this basis, referring to FIG. 4C, the time control circuit 22 further includes a second capacitor C2 and a third capacitor C3. One terminal of the second capacitor C2 is coupled to the gate of the tenth transistor T10, and another terminal of the second capacitor C2 is coupled to the ground terminal GND; one terminal of the third capacitor C3 is coupled to the gate of the seventh transistor T7, and another terminal of the third capacitor C3 is coupled to the ground terminal GND.

The description that one terminal of the second capacitor C2 is coupled to the gate of the tenth transistor T10 may also be understood as that, one terminal of the second capacitor C2 is coupled to the third node N3, and then the third node N3 is coupled to the gate of the tenth transistor T10; similarly, the description that one terminal of the third capacitor C3 is coupled to the gate of the seventh transistor T7 may also be understood as that, one terminal of the third capacitor C3 is coupled to the second node N2, and then the second node N2 is coupled to the gate of the seventh transistor T7.

The second capacitor C2 is used for maintaining a potential at the third node N3, so that the third node N3 may control the tenth transistor T10 to remain on after the eleventh transistor T11 is turned off. The third capacitor C3 is used for maintaining a potential at the second node N2, so that the second node N2 may control the seventh transistor T7 to remain on after the eighth transistor T8 is turned off, which may shorten durations of valid levels in the first control signal and the third control signal, and reduce a power consumption of the pixel circuit 2.

The transistors in the pixel circuit 2 described above may be, for example, P-type thin film transistors or N-type thin film transistors. In the embodiments of the present disclosure, the working process of the pixel circuit 2 is described by taking an example in which the transistors in the pixel circuit 2 are P-type thin film transistors.

Figure 5A:
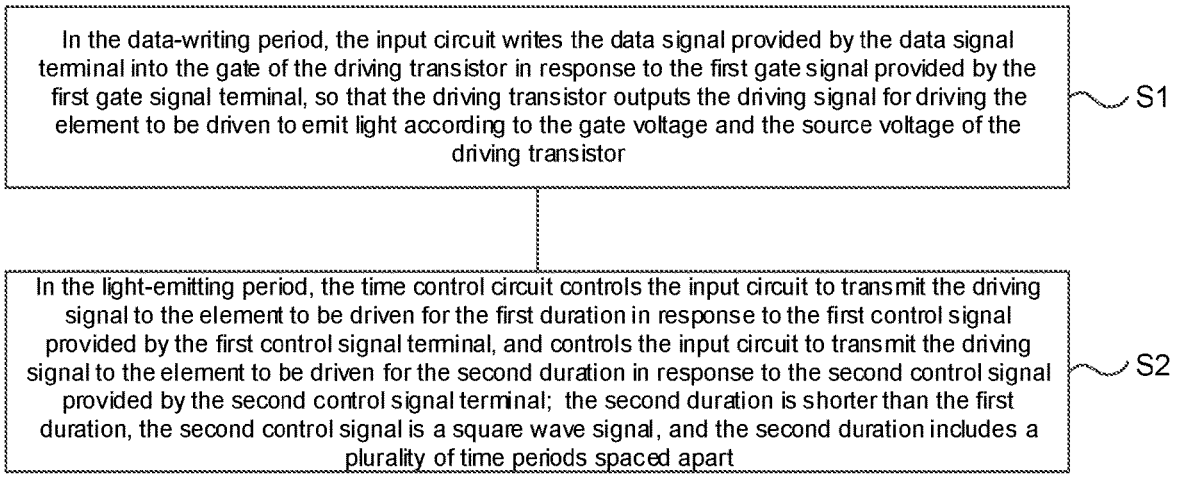
FIG. 5A is a flow diagram of a control method for a pixel circuit, in accordance with some embodiments of the present disclosure.
Figure 5B:
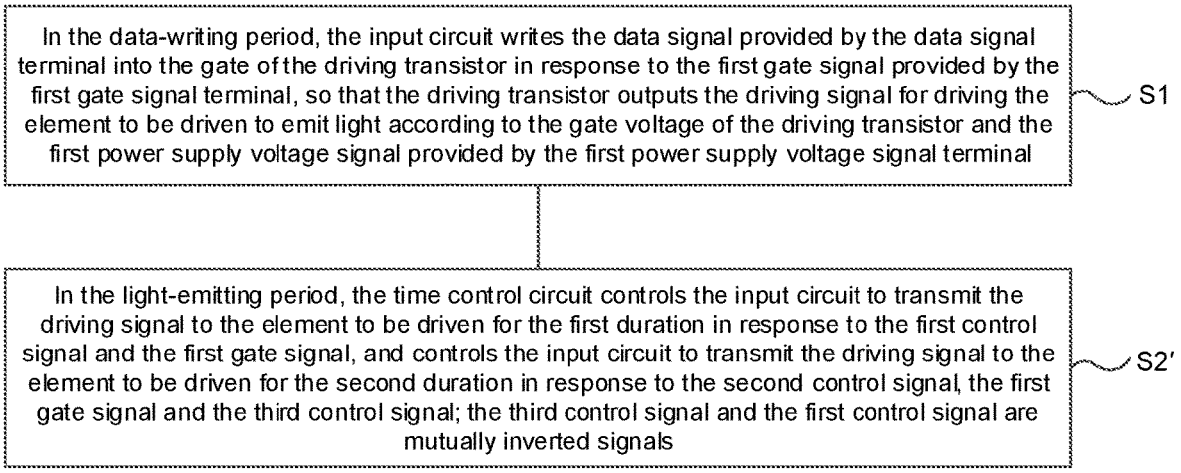
FIG. 5B is another flow diagram of a control method for a pixel circuit, in accordance with some embodiments of the present disclosure.
Figure 5C:
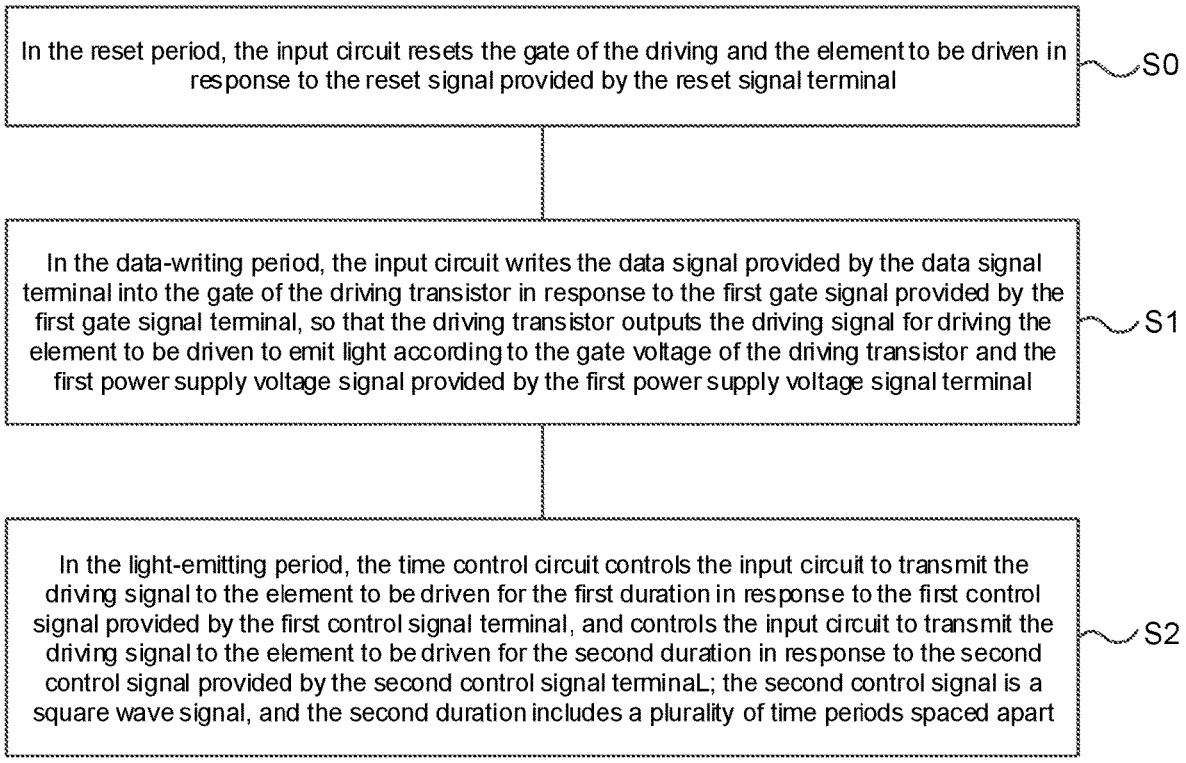
FIG. 5C is yet another flow diagram of a control method for a pixel circuit, in accordance with some embodiments of the present disclosure.

Referring to FIGS. 5A to 5C, embodiments of the present disclosure further provide a control method for the pixel circuit 2 as described above. The control method includes displaying a plurality of frames of image, and when a frame of image in the plurality of frames of image is displayed, a driving period thereof includes at least a data-writing period and a light-emitting period.

In the data-writing period S1, the input circuit 21 writes the data signal provided by the data signal terminal Data-A into the gate of the driving transistor DTFT in response to the first gate signal provided by the first gate signal terminal Gate1, so that the driving transistor DTFT outputs the driving signal used for driving the element to be driven D to emit light according to the gate voltage of the driving transistor DTFT and the source voltage of the driving transistor DTFT.

For example, referring to FIG. 4D, the sixth transistor T6 and the second transistor T2 are turned on under the control of the first gate signal provided by the first gate signal terminal Gate1, so as to write the data signal provided by the data signal terminal Data-A to the gate of the third transistor T3. The third transistor T3 is the driving transistor DTFT.

In the light-emitting period S2, the time control circuit 22 controls the input circuit 21 to transmit the driving signal to the element to be driven D for the first duration T1 in response to the first control signal provided by the first control signal terminal Data-D, and controls the input circuit 21 to transmit the driving signal to the element to be driven D for the second duration T2 in response to the second control signal provided by the second control signal terminal HF; the second duration T2 is shorter than the first duration T1, the second control signal is a square wave signal, and the second duration T2 includes a plurality of time periods t' that are spaced apart.

For example, referring to FIG. 4D, in a case where the input circuit 21 works in the light-emitting period, when the seventh transistor T7 is turned on under the control of the first control signal provided by the first control signal terminal Data-D, the driving signal output by the driving transistor DTFT in the input circuit 21 is transmitted to the anode of the element to be driven D, and the light emission duration of the element to be driven D is the first duration T1; when the ninth transistor T9 is turned on under the control of the second control signal provided by the second control signal terminal HF, the driving signal output by the driving transistor DTFT is transmitted to the anode of element to be driven D, and the light emission duration of the element to be driven D is the second duration T2. Since the second control signal is the square wave signal, the ninth transistor T9 is periodically turned on and off in the process of the input circuit 21 outputting the driving signal, which makes the element to be driven D periodically switch between a bright (light-emitting) state and a dark (non-light-emitting) state. As a result, the second duration T2 includes the plurality of time periods t' spaced apart.

It will be noted that, the first duration T1 and the second duration are both light emission durations of the element to be driven D. The second duration T2 includes the plurality of time periods t' spaced apart, and does not include the time between two adjacent time periods during which the element D is in the dark state.

The control method for the pixel circuit 2 has the same beneficial effect as the pixel circuit 2, and details will not be repeated herein.

In some embodiments, referring to FIG. 5B, the control method may include the following steps.

In the data-writing period S1, the input circuit 21 writes the data signal provided by the data signal terminal Data-A to the gate of the driving transistor DTFT in response to the first gate signal provided by the first gate signal terminal Gate 1, so that the driving transistor DTFT outputs the driving signal used for driving the element to be driven D to emit light according to the gate voltage of the driving transistor DTFT and the first power supply voltage signal provided by the first power supply voltage signal terminal VDD.

For example, the driving signal output by the driving transistor DTFT is a driving current $I_d$.

In the light-emitting period S2', the time control circuit 22 controls the input circuit 21 to transmit the driving signal to the element to be driven D for the first duration T1 in response to the first control signal and the first gate signal, and controls the input circuit 21 to transmit the driving signal to the element to be driven D for the second duration T2 in response to the second control signal, the first gate signal and the third control signal provided by the third control signal terminal Data-D'; the third control signal and the first control signal are mutually inverted signals.

Referring to FIGS. 4C and 5B, in the light-emitting period, the first control sub-circuit 221 controls the light emission duration of the element to be driven D to be the first duration T1 in response to the first control signal and the first gate signal, that is, when the first control circuit 221 in the pixel circuit 2 works, the light emission duration is the first duration T1; or, the time control circuit 22 controls the light emission duration of the element to be driven D to be the second duration T2 in response to the second control signal, the first gate signal and the third control signal, that is, when the second control sub-circuit 222 in the pixel circuit 2 works, the light emission duration is the second duration T2.

Since the third control signal and the first control signal are mutually inverted signals, the seventh transistor T7 and the ninth transistor T9 will not be turned on simultaneously.

The first control sub-circuit 221 and the second control sub-circuit 222 are respectively controlled by using the first control signal and the third control signal that are mutually inverted signals, so that the control process may be simplified.

Figure 5D:
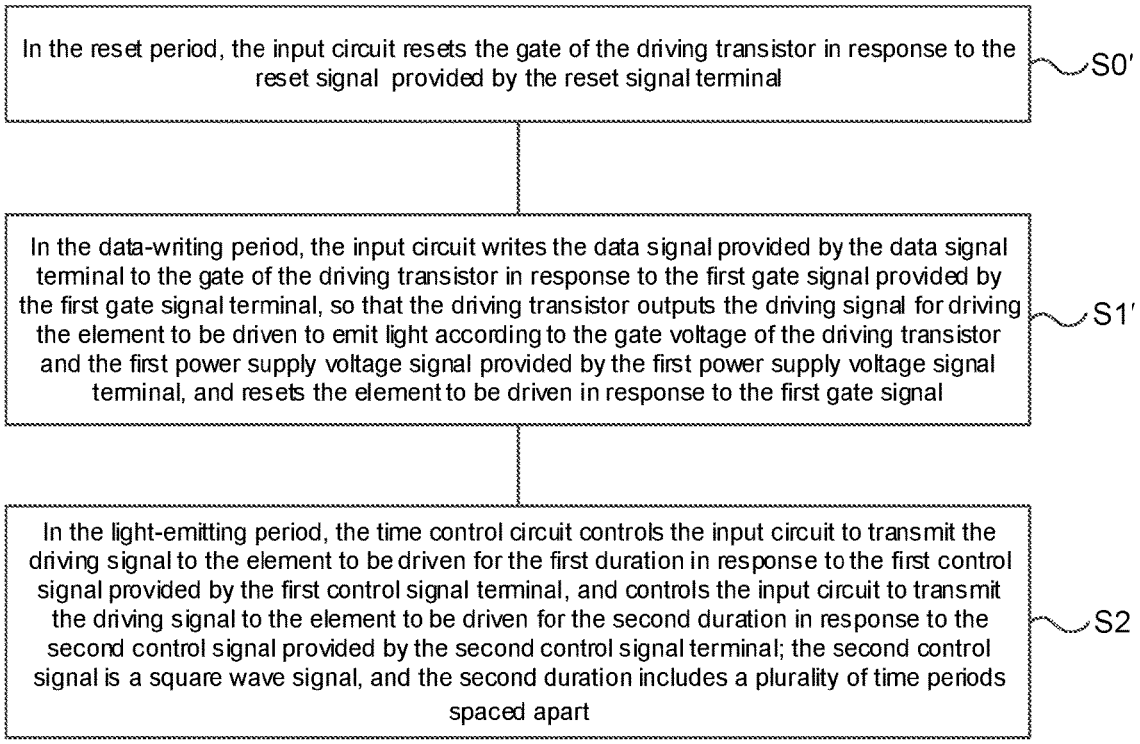
FIG. 5D is yet another flow diagram of a control method for a pixel circuit, in accordance with some embodiments of the present disclosure.

In some embodiments, referring to FIGS. 5C and 5D, the control method further includes a reset period before the data-writing period.

Referring to FIG. 5C, in the reset period S0, the input circuit 21 resets the gate of the driving transistor DTFT and the element to be driven D, in response to the reset signal provided by the reset signal terminal Reset.

For example, referring to FIG. 4B, the gates of the first transistor T1 and the twelfth transistor T12 are both coupled to the reset signal. The first transistor T1 is turned on when the reset signal provided by the reset signal terminal Reset is an active signal, and the initialization signal provided by the initialization signal terminal Vinit may be transmitted to the gate of the driving transistor DTFT, so as to reset the driving transistor DTFT. When the twelfth transistor T12 is turned on, the initialization signal provided by the initialization signal terminal Vinit may be transmitted to the anode of the element to be driven D, so as to reset the element to be driven D.

Or, referring to FIG. 5D, in the reset period S0', the input circuit 21 resets the gate of the driving transistor DTFT, in response to the reset signal provided by the reset signal terminal Reset.

Referring to FIG. 4C, the gate of the first transistor T1 is coupled to the reset signal terminal Reset, and the gate of the twelfth transistor T12 is coupled to the first gate signal terminal Gate1. In the reset period, the reset signal provided by the reset signal terminal Reset is active, and the first transistor T1 is turned on to transmit the initialization signal to the gate of the third transistor T3, so as to reset the third transistor T3.

In the data-writing period S1', the input circuit 21 resets the element to be driven D in response to the first gate signal.

Since the first gate signal is only active during the data-writing period, the twelfth transistor T12 is turned on during the data-writing period, so as to transmit the initialization signal to the anode of the element to be driven D to reset the element to be driven D.

With combination of the structure of the pixel circuit 2 and the timing diagram for the pixel circuit 2, a working process of the pixel circuit 2 during a driving period in a frame of image will be described below.

In the case where the element to be driven D needs to display a medium gray scale or a high gray scale, a stability of the element to be driven D is good. As a result, a difference between actual luminances is small when different elements D to be driven display a same gray scale. Therefore, in this process, different elements D to be driven may display the required brightness by fixing the light emission duration and changing a magnitude of the driving signal, for example, a magnitude of the driving current $I_d$.

Figure 6A:
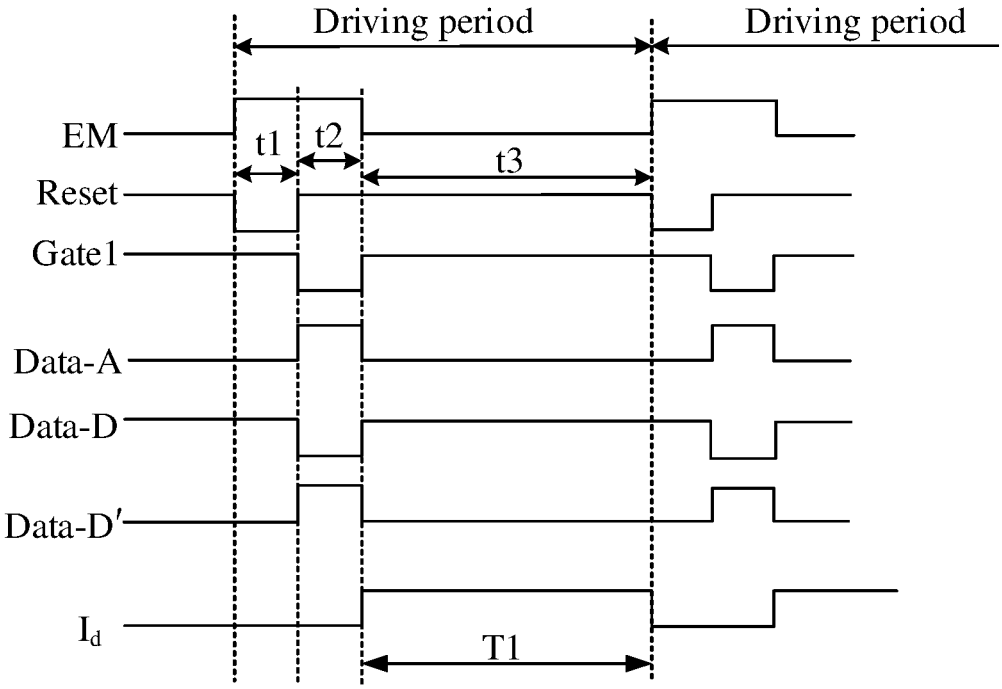
FIG. 6A is a timing diagram of a pixel circuit displaying a medium gray scale and a high gray scale, in accordance with some embodiments of the present disclosure.

For example, for the structure in FIG. 4C, combined with FIG. 6A, in the reset period t1, the reset signal provided by the reset signal terminal Reset is, for example, at a low level, and other signals of the pixel circuit 2 are all at high levels. In this case, only the first transistor T1 is turned on to transmit the initialization signal provided by the initialization signal terminal Vinit to the first node N1 and reset the first node N1, so as to ensure that an initial potential at the first node N1 is correct when the current frame of image is displayed. In this process, no driving current $I_d$ is transmitted to the element to be driven D, and the element to be driven D is in a dark state.

In the data-writing period t2, the pixel circuit 2 writes corresponding potentials to the first node N1, the second node N2 and the third node N3. Specifically, the first gate signal is at a low level, the second transistor T2, the sixth transistor T6, the eighth transistor T8 and the eleventh transistor T11 are turned on. the data signal is written into the first node N1 through the third transistor T3 after the second transistor T2 and the sixth transistor T6 are turned on; the first control signal provided by the first control signal terminal Data-D is written into the second node N2 after the eighth transistor T8 is turned on; the third control signal provided by the third control signal terminal Data-D' is written into the third node N3 after the eleventh transistor T11 is turned on.

In the case where the element to be driven D needs to display the medium gray scale or a high gray scale, the first control signal is set to a low level, so that the seventh transistor T7 may be turned on; at the same time, the third control signal is set to a high level, so that the third node N3 is written to a high potential, and the tenth transistor T10 is turned off. In this case, no signal is written to the sixth node N6, and the ninth transistor T9 is turned off.

In the data-writing period t2, the reset signal and the light emission control signal are both at high levels. The first transistor T1, the fourth transistor T4 and the fifth transistor T5 are turned off, and no driving current $I_d$ is output by the input circuit 21.

Since the first gate signal is at the low level in the data-writing period t2, the twelfth transistor T12 is turned on. Therefore, the initialization signal provided by the initialization signal terminal Vinit is written into the fourth node N4 to reset the fourth node N4, and the element to be driven D is in the dark state. For example, a magnitude of the initialization signal is the same as a magnitude of the second power supply voltage signal VSS, for example, 0V.

In the light-emitting period t3, the reset signal and the first gate signal are at high levels, and the first transistor T1, the second transistor T2, the sixth transistor T6, the eighth transistor T8, the eleventh transistor T11 and the twelfth transistor T12 are turned off.

Due to existence of the first capacitor C1, in the light-emitting period t3, the first capacitor C1 starts to discharge to raise the potential at the first node N1, and the third transistor T3 is turned on. Due to existence of the second capacitor C2, the high potential at the third node N3 may be maintained to keep the tenth transistor T10 off. Due to existence of the third capacitor C3, the low potential at the second node N2 may be maintained to keep the seventh transistor T7 on. Therefore, in a process of displaying the medium gray scale or the high gray scale, the first control sub-circuit 221 may work normally, whereas the second control sub-circuit 222 is in a turn-off state.

In the light-emitting period t3, the light emission control signal is at a low level, the fourth transistor T4 and the fifth transistor T5 are turned on, so as to transmit the first power supply voltage signal provided by the first power supply voltage signal terminal VDD to the first electrode of the third transistor T3. Under the control of the first node N1, the third transistor T3 is turned on and outputs the driving current $I_d$, and the driving current $I_d$ is transmitted to the element to be driven D after it passes through the fifth transistor T5 and the seventh transistor T7, and then the element to be driven D emits light. At this time, the light emission duration of the element to be driven D is the first duration T1, and the element to be driven D keeps emitting light during this duration.

Those skilled in the art may understand that, the potential at the first node N1 determines a magnitude of the driving current $I_d$ generated by the third transistor T3. Since the potential at the first node N1 is written through the data signal, the data signal determines the magnitude of the driving current $I_d$, and different data signals may control the element to be driven D to display at different luminances.

In the case where the element to be driven D needs to display a low gray scale, the stability of the element to be driven D is poor. As a result, actual displayed luminances differ greatly when different elements D to be driven display a same gray scale. Therefore, it is necessary to control the luminances displayed by different elements to be driven by controlling a light emission duration of each element to be driven D under the premise that the element D to be driven can work stably.

Figure 6B:
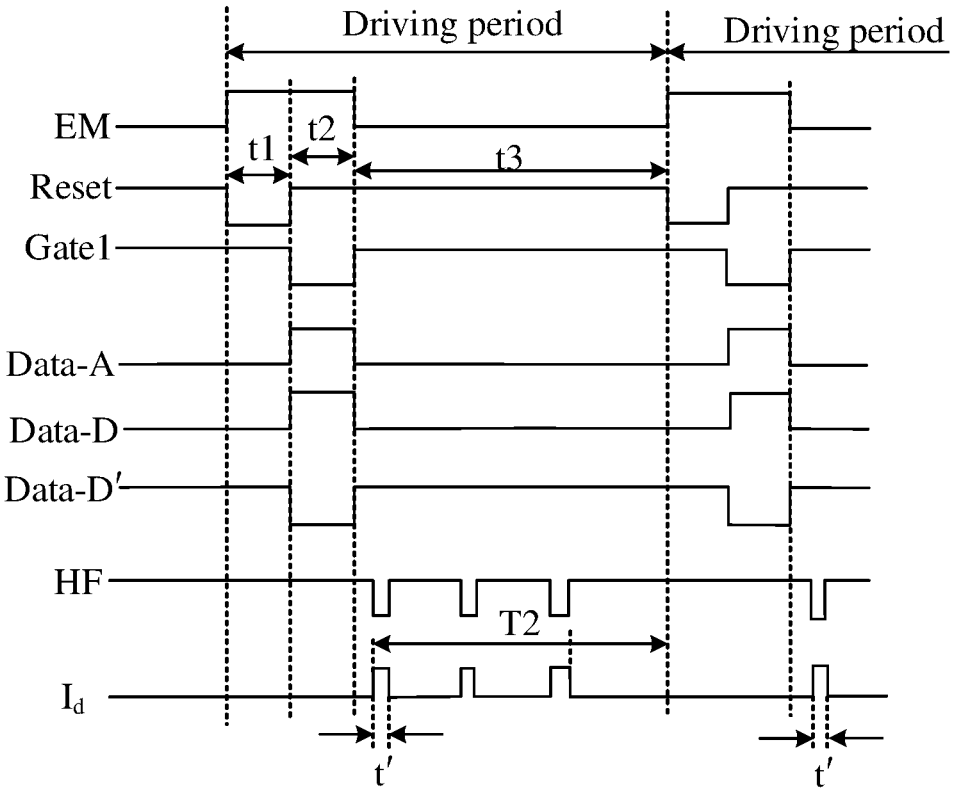
FIG. 6B is a timing diagram of a pixel circuit displaying a low gray scale, in accordance with some embodiments of the present disclosure.
Figure 6C:
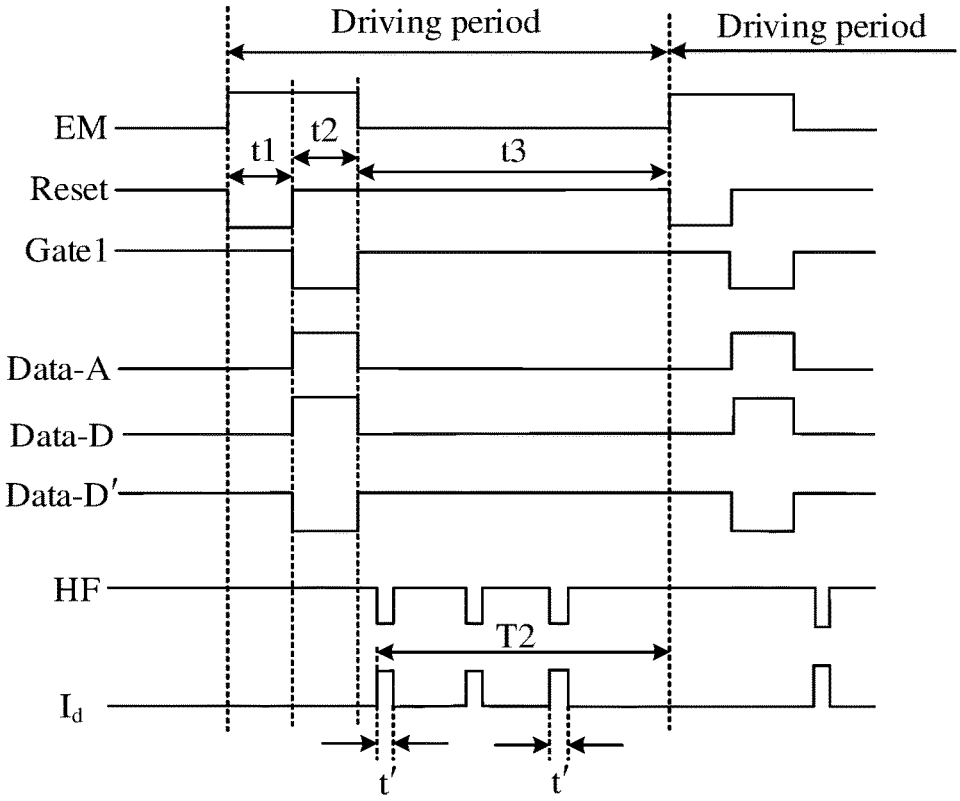
FIG. 6C is a timing diagram of another pixel circuit displaying a low gray scale display, in accordance with some embodiments of the present disclosure.

For example, for the structure of FIG. 4C, with reference to FIGS. 6B or 6C, in the reset period t1, the reset signal provided by the reset signal terminal Reset is at, for example, a low level, and other signals in the pixel circuit 2 are at high level. At this time, only the first transistor T1 is turned on to transmit the initialization signal provided by the initialization signal terminal Vinit to the first node N1, so as to reset the first node N1 and ensure that the initial potential of the first node N1 is correct in the process of displaying the frame of image. In this process, no driving current $I_d$ is transmitted to the element to be driven D, and the element to be driven D is in a dark state.

In the data-writing period t2, the pixel circuit 2 writes corresponding potentials to the first node N1, the second node N2 and the third node N3. Specifically, the first gate signal is at a low level, the second transistor T2, the sixth transistor T6, the eighth transistor T8 and the eleventh transistor T11 are turned on. The data signal provided by the data signal terminal Data-A may be written to the first node N1 through the third transistor T3 after the second transistor T2 and the sixth transistor T6 are turned on. The first control signal provided by the first control signal terminal Data-D may be written to the second node N2 after the eighth transistor T8 is turned on. The third control signal provided by the third control signal terminal Data-D' is written into the third node N3 after the eleventh transistor T11 is turned on.

In the case where the element to be driven D needs to display the low gray scale, the first control signal is set to a high level, so that the seventh transistor T7 is turned off. At a same time, the third control signal is set to a low level, so that a low potential is written into the third node N3, and the tenth transistor T10 is turned on. The second control signal may be written to the sixth node N6 through the tenth transistor T10, so as to control a working state of the ninth transistor T9 through the sixth node N6. Since the second control signal is the square wave signal, the ninth transistor T9 is turned on and off periodically under the control of the sixth node N6. Although the ninth transistor is turned on, since the light emission control signal is at a high level, there is no driving current $I_d$ output from the input circuit 21 at this time.

In the data-writing period t2, the reset signal is at a high level, and thus the first transistor T1 is turned off.

Since the first gate signal is at the low level in the data-writing period t2, the twelfth transistor T12 is turned on. Therefore, the initialization signal provided by the initialization signal terminal Vinit is transmitted to the fourth node N4, the fourth node N4 is reset, and the element to be driven D is in the dark state.

In the light-emitting period t3, the reset signal and the first gate signal are at high levels, and thus the first transistor T1, the second transistor T2, the sixth transistor T6, the eighth transistor T8, the eleventh transistor T11 and the twelfth transistor T12 are turned off.

Due to existence of the first capacitor C1, in the light-emitting period t3, the first capacitor C1 starts to discharge and the potential at the first node N1 is raised, and the third transistor T3 is turned on. Due to existence of the second capacitor C2, the third node N3 may be maintained at the low potential, and the tenth transistor T10 remains on. Due to existence of the third capacitor C3, the high potential at the second node N2 may be maintained, and the seventh transistor T7 remains off. Therefore, in a process of displaying the low gray scale, the second control sub-circuit 222 may work normally, whereas the first control sub-circuit 221 is in a turn-off state.

In the light-emitting period t3, in a time period when the light emission control signal is at a low level, the fourth transistor T4 and the fifth transistor T5 are turned on, and the first power supply voltage signal provided by the first power supply voltage signal terminal VDD is transmitted to the first electrode of the third transistor T3. The third transistor T3 is turned on and outputs the driving current $I_d$ under the control of the first node N1. The driving current $I_d$ flows to the element to be driven D after passing through the fifth transistor T5 and the ninth transistor T9, so as to drive the element to be driven D to emit light. At this time, a total light emission duration of the element to be driven D is the second duration T2. Since the ninth transistor T9 is turned on and off periodically under the control of the second control signal, the second duration T2 includes the plurality of time periods t' spaced apart from each other. For example, referring to the second control signal shown in FIGS. 6B and 6C, which is the square wave signal including continuous and alternating low and high levels, the element to be driven D emits light in each low-level period, and the element to be driven D is in the dark state in each high-level period. Therefore, the element to be driven D switches between the bright state and the dark state. However, since a duration of the dark state between two adjacent bright states is relatively short, human eyes are unable to observe a process in which the element to be driven D is in the dark state, and the element to be driven D is considered to keep emitting light. Therefore, the user considers that the light emission duration of the element to be driven D is longer than a real light emission duration of the element to be driven D. As a result, the user will not think the element to be driven D flickers during the light-emitting process.

On this basis, for example, referring to FIGS. 6A and 6B, a duration in which the light emission control signal is an active signal when the element to be driven D displays the medium gray scale or the high gray scale is equal to a duration in which the light emission control signal is an active signal when the element to be driven D displays the low gray scale. Generally, based on the consideration of a design space of a high-resolution display panel, pixel circuits 2 located in a same row may receive the same light emission control signal, and for the pixel circuits 2 located in the same row, the light emission control signal only includes one active signal period in a frame.

In some embodiments, referring to FIGS. 6A and 6C, a duration in which the light emission control signal is an active signal when the element to be driven D displays the medium gray scale or the high gray scale is longer than the duration in which the light emission control signal is an active signal when the element to be driven D displays the low gray scale, so that each pixel circuit 2 needs to be coupled to one light emission control signal line EM.

Figure 6D:
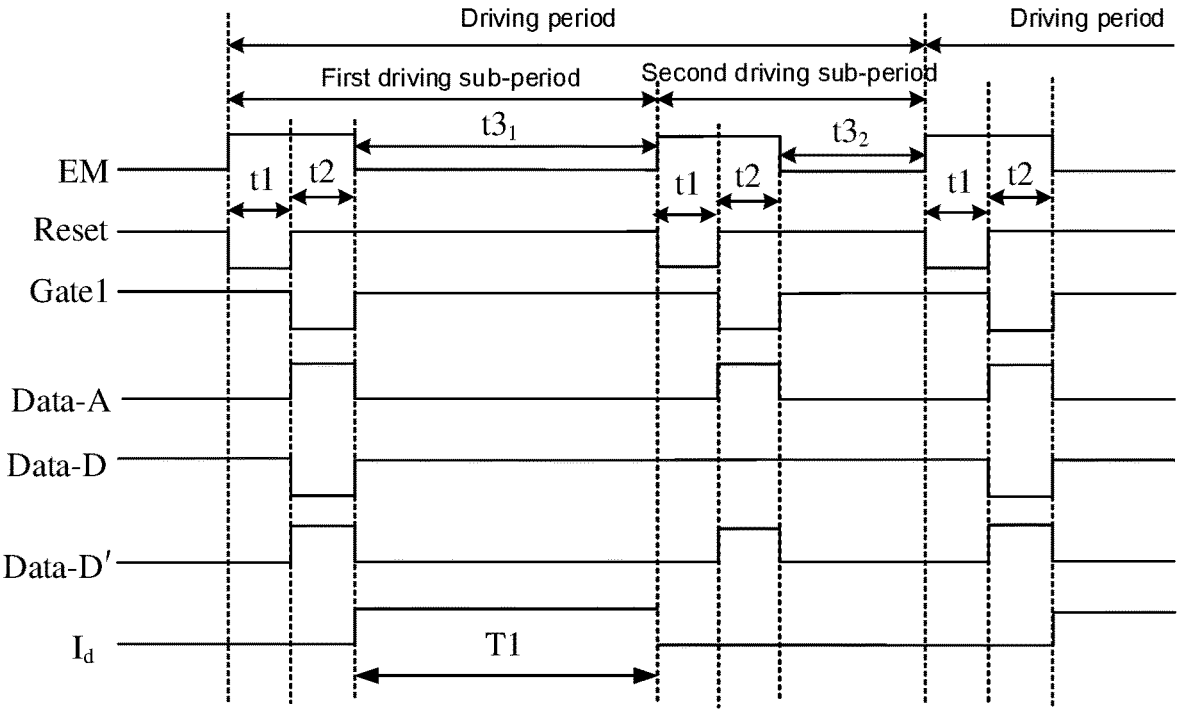
FIG. 6D is a timing diagram of another pixel circuit displaying a medium gray scale and a high gray scale, in accordance with some embodiments of the present disclosure.
Figure 6E:
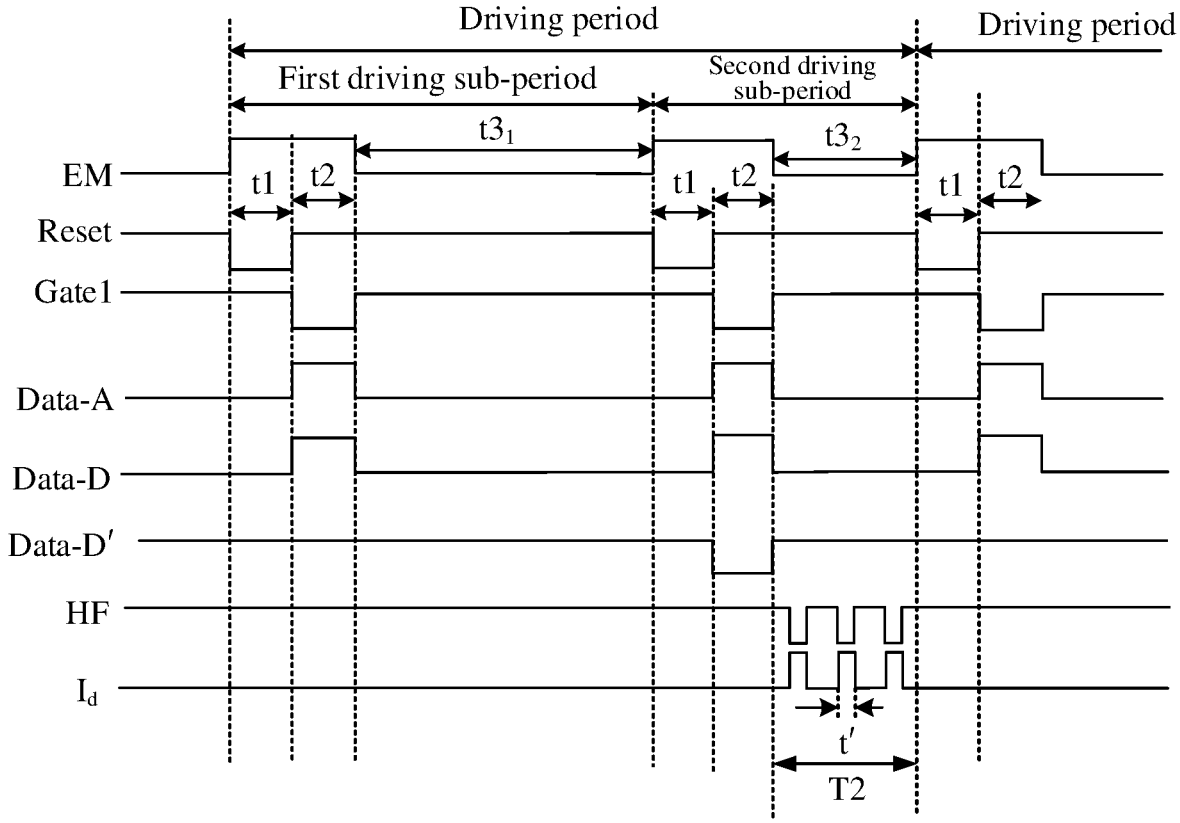
FIG. 6E is a timing diagram of another pixel circuit displaying a low gray scale, in accordance with some embodiments of the present disclosure.
Figure 6F:
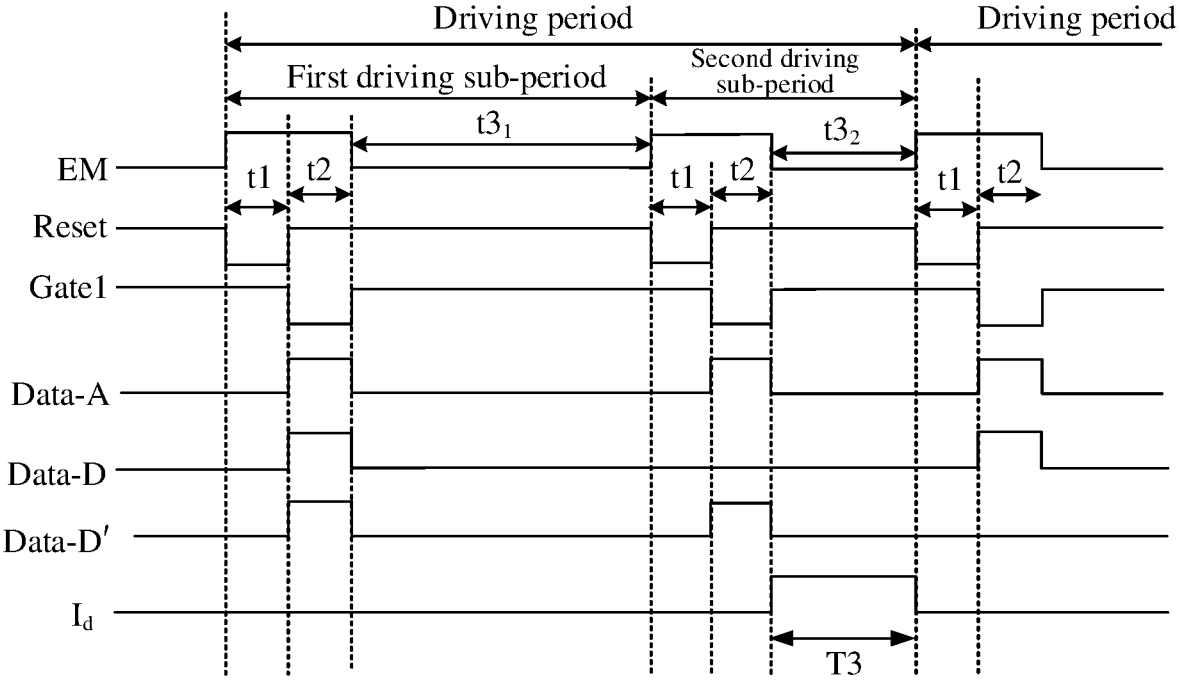
FIG. 6F is a timing diagram of a pixel circuit displaying a medium gray scale, in accordance with some embodiments of the present disclosure.
Figure 6G:
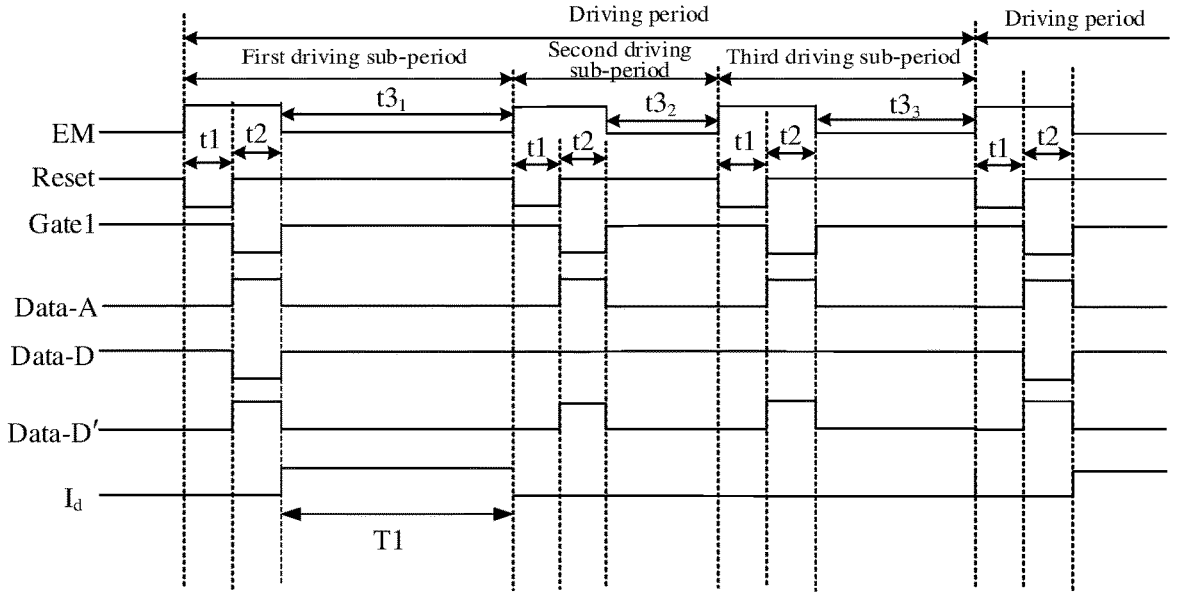
FIG. 6G is a timing diagram of a pixel circuit displaying a high gray scale, in accordance with some embodiments of the present disclosure.
Figure 6H:
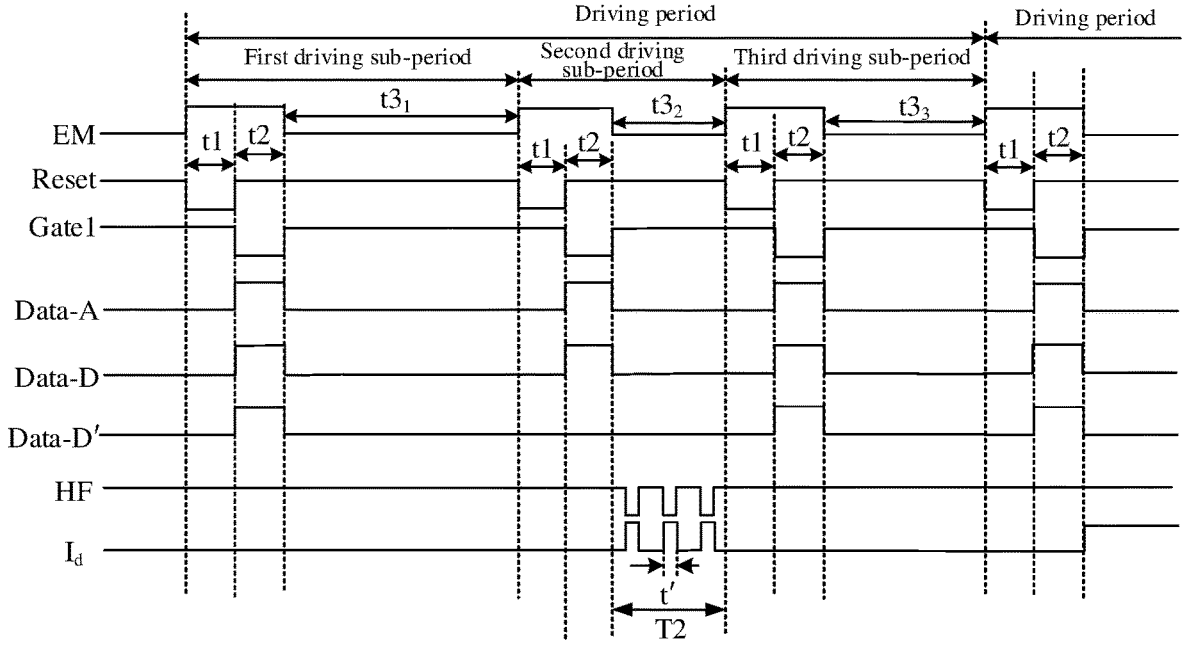
FIG. 6H is a timing diagram of another pixel circuit displaying a low gray scale, in accordance with some embodiments of the present disclosure.
Figure 6I:
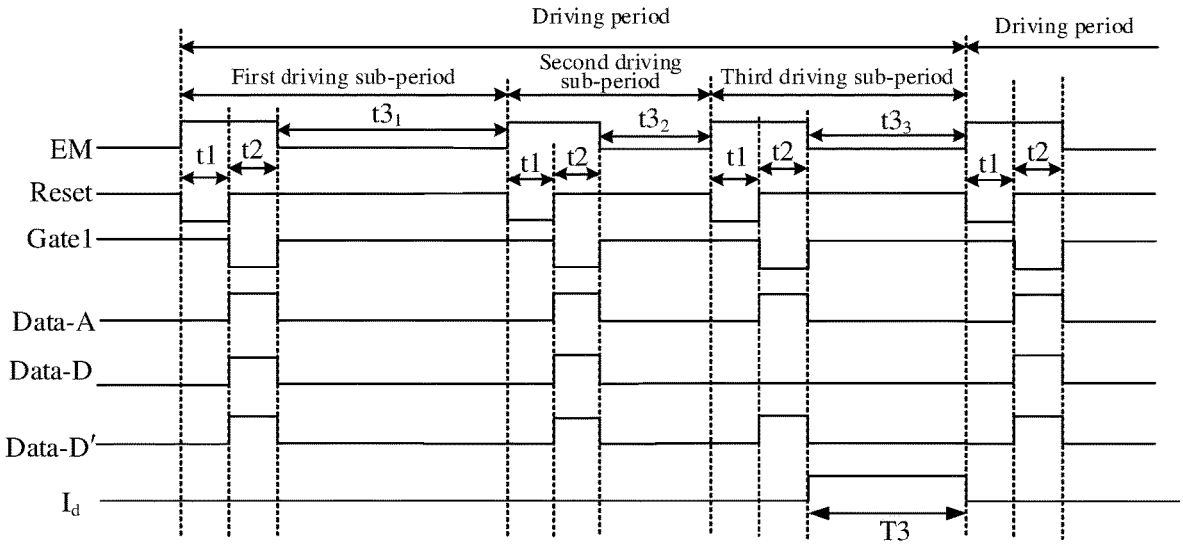
FIG. 6I is a timing diagram of a pixel circuit displaying a medium gray scale, in accordance with some embodiments of the present disclosure.

Based on the above, referring to FIGS. 6A to 6C, in the driving period, the light emission control signal includes one active signal period; or referring to FIGS. 6D to 6F, in the driving period, the light emission control signal includes two active signal periods; or referring to FIGS. 6G to 6I, in the driving period, the light emission control signal includes three active signal periods.

When the display panel adopts timings corresponding to FIGS. 6D to 6I, the pixel circuits 2 located in the same row share a same light emission control signal line EM, thereby decreasing the number of signal lines in the display panel 1, and improving the design space and an active display area of the display panel.

Based on the above, for the structure in FIG. 4C, with reference to FIGS. 6D, 6E or 6F, the driving period includes a first driving sub-period and a second driving sub-period, and the first driving sub-period and the second driving sub-period include the same reset period t1 and the same data-writing period t2. The first driving sub-period includes a light-emitting period $t3_1$, and the second driving sub-period includes a light-emitting period $t3_2$. A duration of the light-emitting period $t3_1$ is longer than a duration of the light-emitting period $t3_2$.

In some embodiments, referring to FIG. 6D, when the element to be driven D needs to display the medium gray scale or the high gray scale, by setting the first control signal to the low level and the third control signal to the high level, the element to be driven D emits light in the light emission duration $t3_1$ of the first driving sub-period, and the light emission duration is the first duration T1. In this case, the first duration T1 is equal to the duration of the light-emitting period $t3_1$, and the second control signal is an inactive signal in this process and thus it is not shown in FIG. 6D. With continued reference to FIG. 6E, when the element to be driven D needs to display the low gray scale, by setting the first control signal to the high level, the second control signal to the square wave signal and the third control signal to the low level, the element to be driven D emits light in the light-emitting period $t3_2$ of the second driving sub-period. The light emission duration is the second duration T2, and the second duration T2 includes a plurality of time periods t' spaced apart from each other.

In some other embodiments, referring to FIG. 6F, when the element to be driven D needs to display the medium gray scale, the element to be driven D may also emit light in the second driving sub-period. At this time, the first control signal is set to the low level, the third control signal is set to the high level, and the second control signal is an inactive signal. The light emission duration of the element to be driven D is the third duration T3, and the third duration T3 is equal to the duration of the light-emitting $t3_2$.

Based on the above, referring to FIGS. 6D to 6F, when the element to be driven D needs to display the medium gray scale, the element to be driven D may emit light in the first driving sub-period, which is the same driving sub-period when the high medium gray scale is displayed. Or, the element to be driven D may emit light in the second driving sub-period, which is the same driving sub-period when the low medium gray scale is displayed. Therefore, the medium gray scale with a larger numerical span may be more accurately displayed, and the display effect is ensured.

It may be known from the above analysis process that, under action of a reasonable configuration of the light emission control signal, the first control signal, the second control signal and the third control signal, the element to be driven D may emit light in the first driving sub-period or the second driving sub-period, according to the luminance to be displayed, and the pixel circuits 2 located in the same row may share the same light emission control signal line EM.

Based on the above, in some other embodiments, for the structure of FIG. 4C, with reference to FIG. 6G, FIG. 6H, or FIG. 6I, the driving period further includes a third driving sub-period. The first driving sub-period, the second driving sub-period and the third driving sub-period include the same reset period t1 and the same data-writing period t2. The first driving sub-period includes the light-emitting period $t3_1$, the second driving sub-period includes the light-emitting period $t3_2$, and the third sub-driving period includes the light-emitting period $t3_3$. A duration of the light-emitting period $t3_1$ is greater than a duration of the light-emitting period $t3_3$, and the duration of the light-emitting period $t3_3$ is greater than a duration of the light-emitting period $t3_2$.

First, referring to FIG. 6G, when the element to be driven D needs to display the high gray scale, by setting the first control signal to the low level and the third control signal to the high level, the element to be driven D emits light in the light-emitting period $t3_1$ of the first driving sub-period. The light emission duration is the first duration T1. In this case, the first duration T1 is equal to the duration of the light-emitting period $t3_1$, and the second control signal is an inactive signal in this process and thus it is not shown in FIG. 6G.

Second, referring to FIG. 6H, when the element D to be driven needs to display the low gray scale, by setting the first control signal to the high level, the second control signal to the square wave signal, and the third control signal to the low level, the element to be driven D emits light in the light-emitting period $t3_2$ of the second driving sub-period. The light emission duration thereof is the second duration T2, and the second duration T2 includes a plurality of time periods t' spaced apart from each other.

At last, referring to FIG. 6I, when the element to be driven D needs to display the medium gray scale, by setting the first control signal to the low level and the third control signal to the high level, the element to be driven D emits light in the light-emitting period $t3_3$ of the third driving sub-period. The light emission duration thereof is the third duration T3. In this case, the third duration T3 is equal to the duration of the light-emitting period $t3_3$, and the second control signal is an inactive signal in this process and thus it is not shown in FIG. 6I.

It can be known from the above analysis process that, when the light emission control signal includes three driving sub-periods (i.e., the first driving sub-period, the second sub-driving period and the third sub-driving period), the element to be driven D may emit light selectively in one of the three driving sub-periods according to the luminance to be displayed of the element to be driven D. Durations of the light-emitting periods t3 in the three driving sub-periods respectively correspond to a low gray scale, a medium gray scale and a high gray scale. Therefore, it is possible to control the light emission duration of the element to be driven D more accurately, and improve the display effect.

In the embodiments of the present disclosure, when the low gray scale is displayed, in the light-emitting period t3, although the input circuit 21 keeps outputting the driving current $I_d$ to the time control circuit 22, the ninth transistor T9 is not always in a turn-on state due to the second control signal, instead, the ninth transistor T9 is turned on and off periodically. Therefore, the element to be driven D emits light as the ninth transistor T9 is turned on, and stops emitting light as the ninth transistor T9 is turned off. That is, the element to be driven D is periodically switched between the bright state and the dark state, and emits light intermittently, so as to visually increase the light emission duration of the element to be driven D, and avoid a problem of poor display effect due to a relatively short light emission duration of the element to be driven D and a relatively long duration of the dark state.

For example, a frame frequency of the display panel 1 is, for example, 60 Hz. That is, the display panel 1 may display 60 frames of image within 1 second, and display duration of each frame of image is equal. On this basis, a frequency of the second control signal is, for example, a high-frequency signal of 3000 HZ, so that each element to be driven D may emit light 50 times in the frame of image, that is, the second duration T2 includes, for example, 50 time periods t'.

It will be noted that, a duty ratio of the second control signal may be designed and adjusted, so that the time period t' may have a same length, or different lengths, which is not limited in the present application.

For example, in the related art and the present disclosure, when a low gray scale is displayed, the light emission duration of the element to be driven D is, for example, 10 microseconds. In the related art, the element to be driven D continuously emits light for 10 microseconds; in the present application, the light emission duration of 10 microseconds is divided into 50 time periods t', and each time period t' is 0.2 microseconds, then the element to be driven D emits light 50 times, intermittently.

In the related art, when the display panel 1 displays the low gray scale, a large driving current $I_d$ is adopted to ensure the element to be driven D work stably. In this case, since the driving current $I_d$ is large, the light emission duration of the element to be driven D is small, and a user may observe the flicker when there is a switch between two frames of image, which affects the display effect of the display panel 1 and the user's experience. In the embodiments of the present disclosure, when the display panel 1 displays the low gray scale, the second time period T2 is divided into the plurality of time periods t' spaced apart from each other, and the element to be driven D changes from continuous light emission in the related art to intermittent light emission in the present disclosure. As a result, the light emission duration of the element to be driven D is prolonged visually, and the duration of the dark state of the element to be driven D is shortened, so that the user may not observe the flicker when there is a switch between two frames of image, thereby improving the display effect of the display panel 1.

Based on the above, in the embodiments of the present disclosure, it may be seen from the analysis process of FIGS. 6A to 6I, in the frame of image, the duration of the driving period of each pixel circuit 2 may be the same, for example, when the timings shown in FIGS. 6A, 6B, 6D to 6I are adopted; the duration of the driving period of each pixel circuit 2 may be different from each other, for example, when the timing shown in FIG. 6C is adopted. Therefore, whether the driving duration of each pixel circuit 2 is the same or not is not limited in the present disclosure.

It will be noted that, in FIGS. 6A to 6I, although it is illustrated that stages in which each signal in two consecutive driving periods is an active signal are the same, this is only for illustration. Those skilled in the art may understand that, for a same pixel circuit 2, a luminance displayed in the current frame of image may be the same as, or different from a luminance displayed in the next frame of image. When they are different, stages in which each signal in two consecutive driving periods of the pixel circuit 2 is an active signal may be different, for example, when a pixel circuit 2 needs to display the high gray scale in the current frame of image, and display the low gray scale in the next frame of image, at this time, the stages in which each signal in two consecutive driving periods of the pixel circuit 2 is an active signal are different. Therefore, the present disclosure is not limited because signals of two consecutive stages shown in FIGS. 6A to 6I are the same.

The foregoing descriptions are merely specific implementations of the present disclosure, but the protection scope of the present disclosure is not limited thereto. Any changes or replacements that a person skilled in the art could conceive of within the technical scope of the present disclosure shall be included in the protection scope of the present disclosure. Therefore, the protection scope of the present disclosure shall be subject to the protection scope of the claims.

What is claimed is:

1. A pixel circuit, comprising:

an input circuit including a driving transistor, the input circuit being configured to write a data signal provided by a data signal terminal into a gate of the driving transistor in response to a first gate signal provided by a first gate signal terminal, so that the driving transistor outputs a driving signal for driving an element to be driven to emit light according to a gate voltage of the driving transistor and a source voltage of the driving transistor; and a time control circuit coupled to the input circuit and configured to be coupled to the element to be driven, the time control circuit being further configured to: control the input circuit to transmit the driving signal to the element to be driven for a first duration in response to a first control signal provided by a first control signal terminal; and control the input circuit to transmit the driving signal to the element to be driven for a second duration in response to a second control signal provided by a second control signal terminal, wherein the second duration is shorter than the first duration, and the second duration includes a plurality of time periods spaced apart.

2. The pixel circuit according to claim 1, wherein the time control circuit is further configured to: control the input circuit to transmit the driving signal to the element to be driven for the first duration in response to the first gate signal; and control the input circuit to transmit the driving signal to the element to be driven for the second duration in response to the first gate signal and a third control signal provided by a third control signal terminal, wherein the third control signal and the first control signal are mutually inverted signals.

3. The pixel circuit according to claim 1, wherein the time control circuit is further configured to: control the input circuit to transmit the driving signal to the element to be driven for the first duration in response to the first gate signal; and control the input circuit to transmit the driving signal to the element to be driven for the second duration in response to a second gate signal provided by a second gate signal terminal, wherein the second gate signal and the first gate signal are mutually inverted signals.

4. The pixel circuit according to claim 1, wherein the time control circuit is further configured to receive the first control signal or the second control signal, in response to a fourth control signal provided by a fourth control signal terminal.

5. The pixel circuit according to claim 1, wherein the input circuit is further configured to reset the gate of the driving transistor, or reset the gate of the driving transistor and an anode of the element to be driven, in response to a reset signal provided by a reset signal terminal.

6. The pixel circuit according to claim 1, wherein the input circuit is further configured to control a first power supply voltage signal provided by a first power supply voltage signal terminal to transmit to the driving transistor, and control the driving signal to transmit to the time control circuit, in response to a light emission control signal provided by a light emission control signal terminal.

7. A display device, comprising the pixel circuit according to claim 1.

8. A control method for the pixel circuit according to claim 1, the control method comprising at least a data-writing period and a light-emitting period;

in the data-writing period, writing, by the input circuit, the data signal provided by the data signal terminal into the gate of the driving transistor in response to the first gate signal provided by the first gate signal terminal, so that the driving transistor outputs the driving signal for driving the element to be driven to emit light according to the gate voltage of the driving transistor and the source voltage of the driving transistor;

in the light-emitting period, controlling, by the time control circuit, the input circuit to transmit the driving signal to the element to be driven for the first duration in response to the first control signal provided by the first control signal terminal, and controlling, by the time control circuit, the input circuit to transmit the driving signal to the element to be driven for the second duration in response to the second control signal provided by the second control signal terminal, wherein the second control signal is a square wave signal, and the second duration includes the plurality of time periods spaced apart.

9. The control method according to claim 8, wherein in the light-emitting period, the time control circuit controls the input circuit to transmit the driving signal to the element to be driven for the first duration further in response to the first gate signal, and controls the input circuit to transmit the driving signal to the element to be driven for the second duration further in response to the first gate signal and a third control signal provided by a third control signal terminal, wherein the third control signal and the first control signal are mutually inverted signals.

10. The control method according to claim 8, further comprising a reset period before the data-writing period;

in the reset period, reseting, by the input circuit, the gate of the driving transistor, in response to a reset signal provided by a reset signal terminal; and/or in the data-writing period, reseting, by the input circuit, the element to be driven, in response to the first gate signal.

11. The control method according to claim 8, wherein a frequency of the second control signal is 3000 HZ.

12. The pixel circuit according to claim 1, wherein the input circuit includes: a second transistor, a third transistor, a sixth transistor and a first capacitor, wherein the third transistor is the driving transistor;

a gate of the second transistor is coupled to the first gate signal terminal, a first electrode of the second transistor is coupled to a second electrode of the third transistor, and a second electrode of the second transistor is coupled to a first node;

a gate of the third transistor is coupled to the first node, a first electrode of the third transistor is coupled to a second electrode of the sixth transistor, and the second electrode of the third transistor is coupled to a fifth node;

a gate of the sixth transistor is coupled to the first gate signal terminal, and a first electrode of the sixth transistor is coupled to the data signal terminal; and a terminal of the first capacitor is coupled to the first node, and another terminal of the first capacitor is coupled to a first power supply voltage signal terminal.

13. The pixel circuit according to claim 12, wherein the input circuit further includes a fourth transistor and a fifth transistor;

a gate of the fourth transistor is coupled to a light emission control signal terminal, a first electrode of the fourth transistor is coupled to the first power supply voltage signal terminal, and a second electrode of the fourth transistor is coupled to the first electrode of the third transistor; and a gate of the fifth transistor is coupled to the light emission control signal terminal, a first electrode of the fifth transistor is coupled to the second electrode of the third transistor, and a second electrode of the fifth transistor is coupled to the time control circuit.

14. The pixel circuit according to claim 12, wherein the input circuit further includes a first transistor; a gate of the first transistor is coupled to a reset signal terminal, a first electrode of the first transistor is coupled to an initialization signal terminal, and a second electrode of the first transistor is coupled to the first node; or the input circuit further includes a first transistor and a twelfth transistor; a gate of the first transistor is coupled to a reset signal terminal, a first electrode of the first transistor is coupled to an initialization signal terminal, and a second electrode of the first transistor is coupled to the first node; and a gate of the twelfth transistor is coupled to the first gate signal terminal, a first electrode of the twelfth transistor is coupled to the initialization signal terminal, and a second electrode of the twelfth transistor is configured to be coupled to an anode of the element to be driven.

15. The pixel circuit according to claim 14, wherein the input circuit further includes a fourth transistor and a fifth transistor;

a gate of the fourth transistor is coupled to a light emission control signal terminal, a first electrode of the fourth transistor is coupled to the first power supply voltage signal terminal, and a second electrode of the fourth transistor is coupled to the first electrode of the third transistor; and a gate of the fifth transistor is coupled to the light emission control signal terminal, a first electrode of the fifth transistor is coupled to the second electrode of the third transistor, and a second electrode of the fifth transistor is coupled to the time control circuit.

16. The pixel circuit according to claim 1, wherein the time control circuit includes a seventh transistor and a ninth transistor;

a gate of the seventh transistor is coupled to the first control signal terminal, a first electrode of the seventh transistor is coupled to the input circuit, and a second electrode of the seventh transistor is configured to be coupled to the element to be driven; and a gate of the ninth transistor is coupled to the second control signal terminal, a first electrode of the ninth transistor is coupled to the input circuit, and a second electrode of the ninth transistor is configured to be coupled to the element to be driven.

17. The pixel circuit according to claim 16, wherein the time control circuit further includes an eighth transistor and a tenth transistor;

a gate of the eighth transistor is coupled to the first gate signal terminal, a first electrode of the eighth transistor is coupled to the first control signal terminal, and a second electrode of the eighth transistor is coupled to the gate of the seventh transistor; and a gate of the tenth transistor is coupled to a second gate signal terminal, a first electrode of the tenth transistor is coupled to the second control signal terminal, and a second electrode of the tenth transistor is coupled to the gate of the ninth transistor, wherein a second gate signal provided by the second gate signal terminal and the first gate signal provided by the first gate signal terminal are mutually inverted signals.

18. The pixel circuit according to claim 16, wherein the time control circuit further includes an eighth transistor, a tenth transistor and an inverter;

a gate of the eighth transistor is coupled to a fourth control signal terminal, a first electrode of the eighth transistor is coupled to the first control signal terminal, and a second electrode of the eighth transistor is coupled to the gate of the seventh transistor;

a gate of the tenth transistor is coupled to an output terminal of the inverter, a first electrode of the tenth transistor is coupled to the second control signal terminal, and a second electrode of the tenth transistor is coupled to the gate of the ninth transistor; and an input terminal of the inverter is coupled to the fourth control signal terminal.

19. The pixel circuit according to claim 16, wherein the time control circuit further includes an eighth transistor, a tenth transistor and an eleventh transistor;

a gate of the eighth transistor is coupled to the first gate signal terminal, a first electrode of the eighth transistor is coupled to the first control signal terminal, and a second electrode of the eighth transistor is coupled to the gate of the seventh transistor;

a gate of the tenth transistor is coupled to a second electrode of the eleventh transistor, a first electrode of the tenth transistor is coupled to the second control signal terminal, and a second electrode of the tenth transistor is coupled to the gate of the ninth transistor; and a gate of the eleventh transistor is coupled to the first gate signal terminal, and a first electrode of the eleventh transistor is coupled to a third control signal terminal.

20. The pixel circuit according to claim 19, wherein the time control circuit further includes a second capacitor and a third capacitor; a terminal of the second capacitor is coupled to the gate of the tenth transistor, another terminal of the second capacitor is coupled to a ground terminal; and a terminal of the third capacitor is coupled to the gate of the seventh transistor, and another terminal of the third capacitor is coupled to the ground terminal.

* * * * *